US010857448B2

(12) United States Patent
Kelly et al.

(10) Patent No.: US 10,857,448 B2
(45) **Date of Patent: *Dec. 8, 2020**

(54) CARD HANDLING DEVICES AND ASSOCIATED METHODS

(71) Applicant: SG Gaming, Inc., Las Vegas, NV (US)

(72) Inventors: James V. Kelly, Las Vegas, NV (US); James P. Helgesen, Eden Prairie, MN (US); Vladislav Zvercov, Las Vegas, NV (US); Feraidoon Bourbour, Eden Prairie, MN (US); Robert J. Rynda, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/677,222

(22) Filed: Nov. 7, 2019

(65) Prior Publication Data

US 2020/0122020 A1 Apr. 23, 2020

Related U.S. Application Data

(63) Continuation of application No. 15/360,359, filed on Nov. 23, 2016, now Pat. No. 10,486,055, which is a (Continued)

(51) Int. Cl.
*A63F 1/12* (2006.01)
*A63F 1/06* (2006.01)

(Continued)

(52) U.S. Cl.
CPC ..... *A63F 1/12* (2013.01); *A63F 1/067* (2013.01); *A63F 1/14* (2013.01); *A63F 11/0002* (2013.01)

(58) Field of Classification Search
CPC .... A63F 1/12; A63F 1/067; A63F 1/14; A63F 11/0002

(Continued)

(56) References Cited

U.S. PATENT DOCUMENTS 130,281 A 8/1872 Coughlin
205,030 A 6/1878 Ash (Continued)

FOREIGN PATENT DOCUMENTS

AU 2383667 A 1/1969
AU 5025479 A 3/1980

(Continued)

OTHER PUBLICATIONS

"Error Back propagation," http://willamette.edu~gorr/classes/cs449/backprop.html(4 pages), Nov 13, 2008.

(Continued)

*Primary Examiner* — Benjamin Layno
(74) *Attorney, Agent, or Firm* — TraskBritt

(57) ABSTRACT

A playing card handling device comprises an elevator platform configured to receive one or more cards from an input platform to form a shuffled set of cards, a card gripper positioned above the elevator platform, and configured to grip cards from the shuffled set of cards, and a processor configured to control the elevator platform to have a grip position for the card gripper to grip the shuffled set of cards, wherein the grip position is adjusted based, at least in part, on a correction value associated with a particular card insertion. A related method includes determining a grip position of an elevator platform of a card handling device based, at least in part, on a desired insertion location within a stack of shuffled cards as adjusted based on a corrective value that is different for a plurality of different insertion locations.

19 Claims, 16 Drawing Sheets

Related U.S. Application Data continuation of application No. 14/491,822, filed on Sep. 19, 2014, now Pat. No. 9,504,905.

(51) Int. Cl.
*A63F 11/00* (2006.01)
*A63F 1/14* (2006.01)

(58) Field of Classification Search
USPC ..... 273/149 R, 149 P; 463/22
See application file for complete search history.

(56) References Cited

U.S. PATENT DOCUMENTS 609,730 A 8/1898 Booth
673,154 A 4/1901 Bellows
793,489 A 6/1905 Williams
892,389 A 7/1908 Bellows
1,014,219 A 1/1912 Hall
1,043,109 A 11/1912 Hurm
1,157,898 A 10/1915 Perret
1,256,509 A 2/1918 Belknap
1,380,898 A 6/1921 Hall
1,556,856 A 10/1925 Lipps
1,757,553 A 5/1930 Tauschek
1,850,114 A 3/1932 McCaddin
1,885,276 A 11/1932 McKay
1,889,729 A 11/1932 Hammond
1,955,926 A 4/1934 Matthaey
1,992,085 A 2/1935 McKay
1,998,690 A 4/1935 William et al.
2,001,220 A 5/1935 Smith
2,001,918 A 5/1935 Nevius
2,016,030 A 10/1935 Woodruff et al.
2,043,343 A 6/1936 Warner
2,060,096 A 11/1936 McCoy
2,065,824 A 12/1936 Plass
2,159,958 A 5/1939 Sachs
2,185,474 A 1/1940 Nott
2,254,484 A 9/1941 Hutchins
D132,360 S 5/1942 Gardner
2,328,153 A 8/1943 Laing
2,328,879 A 9/1943 Issacson
D139,530 S 11/1944 Schindler
2,364,413 A 12/1944 Wittel
2,525,305 A 10/1950 Lombard
2,543,522 A 2/1951 Cohen
2,588,582 A 3/1952 Sivertson
2,615,719 A 10/1952 Fonken
2,659,607 A 11/1953 Skillman et al.
2,661,215 A 12/1953 Stevens
2,676,020 A 4/1954 Ogden
2,692,777 A 10/1954 Miller
2,701,720 A 2/1955 Ogden
2,705,638 A 4/1955 Newcomb
2,711,319 A 6/1955 Earl et al.
2,714,510 A 8/1955 Oppenlander et al.
2,717,782 A 9/1955 Droll
2,727,747 A 12/1955 Semisch, Jr.
2,731,271 A 1/1956 Brown
2,747,877 A 5/1956 Howard
2,755,090 A 7/1956 Aldrich
2,757,005 A 7/1956 Nothaft
2,760,779 A 8/1956 Ogden et al.
2,770,459 A 11/1956 Wilson et al.
2,778,643 A 1/1957 Williams
2,778,644 A 1/1957 Stephenson
2,782,040 A 2/1957 Matter
2,790,641 A 4/1957 Adams
2,793,863 A 5/1957 Liebelt
2,815,214 A 12/1957 Hall
2,821,399 A 1/1958 Heinoo
2,914,215 A 11/1959 Neidig
2,937,739 A 5/1960 Levy
2,950,005 A 8/1960 MacDonald
RE24,986 E 5/1961 Stephenson
3,067,885 A 12/1962 Kohler
3,107,096 A 10/1963 Osborn
3,124,674 A 3/1964 Edwards et al.
3,131,935 A 5/1964 Gronneberg
3,147,978 A 9/1964 Sjostrand
D200,652 S 3/1965 Fisk
3,222,071 A 12/1965 Lang
3,235,741 A 2/1966 Plaisance
3,288,308 A 11/1966 Gingher
3,305,237 A 2/1967 Granius
3,312,473 A 4/1967 Friedman et al.
3,452,509 A 7/1969 Hauer
3,530,968 A 9/1970 Palmer
3,588,116 A 6/1971 Miura
3,589,730 A 6/1971 Slay
3,595,388 A 7/1971 Castaldi
3,597,076 A 8/1971 Hubbard et al.
3,598,396 A 8/1971 Andrews et al.
3,618,933 A 11/1971 Roggenstein et al.
3,627,331 A 12/1971 Erickson
3,666,270 A 5/1972 Mazur
3,680,853 A 8/1972 Houghton et al.
3,690,670 A 9/1972 Cassady et al.
3,704,938 A 12/1972 Fanselow
3,716,238 A 2/1973 Porter
3,751,041 A 8/1973 Seifert
3,761,079 A 9/1973 Azure
3,810,627 A 5/1974 Levy
D232,953 S 9/1974 Shigeo
3,861,261 A 1/1975 Maxey
3,897,954 A 8/1975 Erickson et al.
3,899,178 A 8/1975 Watanabe
3,909,002 A 9/1975 Levy
3,929,339 A 12/1975 Mattioli
3,944,077 A 3/1976 Green
3,944,230 A 3/1976 Fineman
3,949,219 A 4/1976 Crouse
3,968,364 A 7/1976 Miller
4,023,705 A 5/1977 Reiner et al.
4,033,590 A 7/1977 Pic
4,072,930 A 2/1978 Lucero et al.
4,088,265 A 5/1978 Garczynski
4,151,410 A 4/1979 McMillan et al.
4,159,581 A 7/1979 Lichtenberg
4,162,649 A 7/1979 Thornton
4,166,615 A 9/1979 Kurokawa et al.
4,232,861 A 11/1980 Maul
4,280,690 A 7/1981 Hill
4,283,709 A 8/1981 Lucero et al.
4,310,160 A 1/1982 Willette et al.
4,339,134 A 7/1982 Macheel
4,339,798 A 7/1982 Hedges et al.
4,361,393 A 11/1982 Noto
4,368,972 A 1/1983 Naramore
4,369,972 A 1/1983 Parker
4,374,309 A 2/1983 Walton
4,377,285 A 3/1983 Kadlic
4,385,827 A 5/1983 Naramore
4,388,994 A 6/1983 Suda et al.
4,397,469 A 8/1983 Carter, III
4,421,312 A 12/1983 Delgado et al.
4,421,501 A 12/1983 Scheffer
D273,962 S 5/1984 Fromm
D274,069 S 5/1984 Fromm
4,467,424 A 8/1984 Hedges et al.
4,494,197 A 1/1985 Troy et al.
4,497,488 A 2/1985 Plevyak et al.
4,512,580 A 4/1985 Matviak
4,513,969 A 4/1985 Samsel, Jr.
4,515,367 A 5/1985 Howard
4,531,187 A 7/1985 Uhland
4,534,562 A 8/1985 Cuff et al.
4,549,738 A 10/1985 Greitzer
4,566,782 A 1/1986 Britt et al.
4,575,367 A 3/1986 Karmel
4,586,712 A 5/1986 Lorber et al.
4,659,082 A 4/1987 Greenberg
4,662,637 A 5/1987 Pfeiffer

(56) References Cited

U.S. PATENT DOCUMENTS

| | | | |
|---|---|---|---|
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak et al. |
| 4,858,000 | A | 8/1989 | Lu |
| 4,861,041 | A | 8/1989 | Jones et al. |
| 4,876,000 | A | 10/1989 | Mikhail |
| 4,900,009 | A | 2/1990 | Kitahara et al. |
| 4,904,830 | A | 2/1990 | Rizzuto |
| 4,921,109 | A | 5/1990 | Hasuo et al. |
| 4,926,327 | A | 5/1990 | Sidley |
| 4,948,134 | A | 8/1990 | Suttle et al. |
| 4,951,950 | A | 8/1990 | Normand et al. |
| 4,969,648 | A | 11/1990 | Hollinger et al. |
| 4,993,587 | A | 2/1991 | Abe |
| 4,995,615 | A | 2/1991 | Cheng |
| 5,000,453 | A | 3/1991 | Stevens et al. |
| 5,004,218 | A | 4/1991 | Sardano et al. |
| 5,039,102 | A | 8/1991 | Miller |
| 5,067,713 | A | 11/1991 | Soules et al. |
| 5,078,405 | A | 1/1992 | Jones et al. |
| 5,081,487 | A | 1/1992 | Hoyer et al. |
| 5,096,197 | A | 3/1992 | Embury |
| 5,102,293 | A | 4/1992 | Schneider |
| 5,118,114 | A | 6/1992 | Tucci |
| 5,121,192 | A | 6/1992 | Kazui |
| 5,121,921 | A | 6/1992 | Friedman et al. |
| 5,146,346 | A | 9/1992 | Knoll |
| 5,154,429 | A | 10/1992 | Levasseur |
| 5,179,517 | A | 1/1993 | Sarbin et al. |
| 5,197,094 | A | 3/1993 | Tillery et al. |
| 5,199,710 | A | 4/1993 | Lamle |
| 5,209,476 | A | 5/1993 | Eiba |
| 5,224,712 | A | 7/1993 | Laughlin et al. |
| 5,240,140 | A | 8/1993 | Huen |
| 5,248,142 | A | 9/1993 | Breeding |
| 5,257,179 | A | 10/1993 | Demar |
| 5,259,907 | A | 11/1993 | Soules et al. |
| 5,261,667 | A | 11/1993 | Breeding |
| 5,267,248 | A | 11/1993 | Reyner |
| 5,275,411 | A | 1/1994 | Breeding |
| 5,276,312 | A | 1/1994 | McCarthy |
| 5,283,422 | A | 2/1994 | Storch et al. |
| 5,288,081 | A | 2/1994 | Breeding |
| 5,299,089 | A | 3/1994 | Lwee |
| 5,303,921 | A | 4/1994 | Breeding |
| 5,344,146 | A | 9/1994 | Lee |
| 5,356,145 | A | 10/1994 | Verschoor |
| 5,362,053 | A | 11/1994 | Miller |
| 5,374,061 | A | 12/1994 | Albrecht |
| 5,377,973 | A | 1/1995 | Jones et al. |
| 5,382,024 | A | 1/1995 | Blaha |
| 5,382,025 | A | 1/1995 | Sklansky et al. |
| 5,390,910 | A | 2/1995 | Mandel et al. |
| 5,397,128 | A | 3/1995 | Hesse et al. |
| 5,397,133 | A | 3/1995 | Penzias |
| 5,416,308 | A | 5/1995 | Hood et al. |
| 5,431,399 | A | 7/1995 | Kelley |
| 5,431,407 | A | 7/1995 | Hofberg et al. |
| 5,437,462 | A | 8/1995 | Breeding |
| 5,445,377 | A | 8/1995 | Steinbach |
| 5,470,079 | A | 11/1995 | Lestrange et al. |
| D365,853 | S | 1/1996 | Zadro |
| 5,489,101 | A | 2/1996 | Moody |
| 5,515,477 | A | 5/1996 | Sutherland |
| 5,524,888 | A | 6/1996 | Heidel |
| 5,531,448 | A | 7/1996 | Moody |
| 5,544,892 | A | 8/1996 | Breeding |
| 5,575,475 | A | 11/1996 | Steinbach |
| 5,584,483 | A | 12/1996 | Sines et al. |
| 5,586,766 | A | 12/1996 | Forte et al. |
| 5,586,936 | A | 12/1996 | Bennett et al. |
| 5,605,334 | A | 2/1997 | McCrea, Jr. |
| 5,613,912 | A | 3/1997 | Slater |
| 5,632,483 | A | 5/1997 | Garczynski et al. |
| 5,636,843 | A | 6/1997 | Roberts |
| 5,651,548 | A | 7/1997 | French et al. |
| 5,655,961 | A | 8/1997 | Acres et al. |
| 5,655,966 | A | 8/1997 | Werdin et al. |
| 5,669,816 | A | 9/1997 | Garczynski et al. |
| 5,676,231 | A | 10/1997 | Legras et al. |
| 5,676,372 | A | 10/1997 | Sines et al. |
| 5,681,039 | A | 10/1997 | Miller |
| 5,683,085 | A | 11/1997 | Johnson et al. |
| 5,685,543 | A | 11/1997 | Garner |
| 5,690,324 | A | 11/1997 | Otomo et al. |
| 5,692,748 | A | 12/1997 | Frisco et al. |
| 5,695,189 | A | 12/1997 | Breeding et al. |
| 5,701,565 | A | 12/1997 | Morgan |
| 5,707,286 | A | 1/1998 | Carlson |
| 5,707,287 | A | 1/1998 | McCrea, Jr. |
| 5,711,525 | A | 1/1998 | Breeding |
| 5,718,427 | A | 2/1998 | Cranford et al. |
| 5,719,288 | A | 2/1998 | Sens et al. |
| 5,720,484 | A | 2/1998 | Hsu |
| 5,722,893 | A | 3/1998 | Hill et al. |
| 5,735,525 | A | 4/1998 | McCrea, Jr. |
| 5,735,724 | A | 4/1998 | Udagawa |
| 5,735,742 | A | 4/1998 | French |
| 5,743,798 | A | 4/1998 | Adams et al. |
| 5,768,382 | A | 6/1998 | Schneier et al. |
| 5,770,533 | A | 6/1998 | Franchi |
| 5,770,553 | A | 6/1998 | Kroner et al. |
| 5,772,505 | A | 6/1998 | Garczynski et al. |
| 5,779,546 | A | 7/1998 | Meissner et al. |
| 5,781,647 | A | 7/1998 | Fishbine et al. |
| 5,785,321 | A | 7/1998 | Van et al. |
| 5,788,574 | A | 8/1998 | Ornstein et al. |
| 5,791,988 | A | 8/1998 | Nomi |
| 5,802,560 | A | 9/1998 | Joseph et al. |
| 5,803,808 | A | 9/1998 | Strisower |
| 5,810,355 | A | 9/1998 | Trilli |
| 5,813,326 | A | 9/1998 | Salomon |
| 5,813,912 | A | 9/1998 | Shultz |
| 5,814,796 | A | 9/1998 | Benson et al. |
| 5,836,775 | A | 11/1998 | Hiyama et al. |
| 5,839,730 | A | 11/1998 | Pike |
| 5,845,906 | A | 12/1998 | Wirth |
| 5,851,011 | A | 12/1998 | Lott |
| 5,867,586 | A | 2/1999 | Liang |
| 5,879,233 | A | 3/1999 | Stupero |
| 5,883,804 | A | 3/1999 | Christensen |
| 5,890,717 | A | 4/1999 | Rosewarne et al. |
| 5,892,210 | A | 4/1999 | Levasseur |
| 5,909,876 | A | 6/1999 | Brown |
| 5,911,626 | A | 6/1999 | McCrea, Jr. |
| 5,919,090 | A | 7/1999 | Mothwurf |
| D412,723 | S | 8/1999 | Hachuel et al. |
| 5,936,222 | A | 8/1999 | Korsunsky et al. |
| 5,941,769 | A | 8/1999 | Order |
| 5,944,310 | A | 8/1999 | Johnson et al. |
| D414,527 | S | 9/1999 | Tedham |
| 5,957,776 | A | 9/1999 | Hoehne |
| 5,974,150 | A | 10/1999 | Kaish et al. |
| 5,989,122 | A | 11/1999 | Roblejo |
| 5,991,308 | A | 11/1999 | Fuhrmann et al. |
| 6,015,311 | A | 1/2000 | Benjamin et al. |
| 6,019,368 | A | 2/2000 | Sines et al. |
| 6,019,374 | A | 2/2000 | Breeding |
| 6,039,650 | A | 3/2000 | Hill |
| 6,050,569 | A | 4/2000 | Taylor |
| 6,053,695 | A | 4/2000 | Longoria et al. |
| 6,061,449 | A | 5/2000 | Candelore et al. |
| 6,068,258 | A | 5/2000 | Breeding et al. |
| 6,069,564 | A | 5/2000 | Hatano et al. |
| 6,071,190 | A | 6/2000 | Weiss et al. |
| 6,093,103 | A | 7/2000 | McCrea, Jr. |

(56) References Cited

U.S. PATENT DOCUMENTS

| | | | |
|---|---|---|---|
| 6,113,101 | A | 9/2000 | Wirth |
| 6,117,012 | A | 9/2000 | McCrea, Jr. |
| 6,123,010 | A | 9/2000 | Blackstone |
| D432,588 | S | 10/2000 | Tedham |
| 6,126,166 | A | 10/2000 | Lorson et al. |
| 6,131,817 | A | 10/2000 | Miller |
| 6,139,014 | A | 10/2000 | Breeding et al. |
| 6,149,154 | A | 11/2000 | Grauzer et al. |
| 6,154,131 | A | 11/2000 | Jones et al. |
| 6,165,069 | A | 12/2000 | Sines et al. |
| 6,165,072 | A | 12/2000 | Davis et al. |
| 6,183,362 | B1 | 2/2001 | Boushy |
| 6,186,895 | B1 | 2/2001 | Oliver |
| 6,196,416 | B1 | 3/2001 | Seagle |
| 6,200,218 | B1 | 3/2001 | Lindsay |
| 6,210,274 | B1 | 4/2001 | Carlson |
| 6,213,310 | B1 | 4/2001 | Wennersten et al. |
| 6,217,447 | B1 | 4/2001 | Lofink et al. |
| 6,234,900 | B1 | 5/2001 | Cumbers |
| 6,236,223 | B1 | 5/2001 | Brady et al. |
| 6,250,632 | B1 | 6/2001 | Albrecht |
| 6,254,002 | B1 | 7/2001 | Litman |
| 6,254,096 | B1 | 7/2001 | Grauzer et al. |
| 6,254,484 | B1 | 7/2001 | McCrea, Jr. |
| 6,257,981 | B1 | 7/2001 | Acres et al. |
| 6,267,248 | B1 | 7/2001 | Johnson et al. |
| 6,267,648 | B1 | 7/2001 | Katayama et al. |
| 6,267,671 | B1 | 7/2001 | Hogan |
| 6,270,404 | B2 | 8/2001 | Sines et al. |
| 6,272,223 | B1 | 8/2001 | Carlson |
| 6,293,546 | B1 | 9/2001 | Hessing et al. |
| 6,293,864 | B1 | 9/2001 | Romero |
| 6,299,167 | B1 | 10/2001 | Sines et al. |
| 6,299,534 | B1 | 10/2001 | Breeding et al. |
| 6,299,536 | B1 | 10/2001 | Hill |
| 6,308,886 | B1 | 10/2001 | Benson et al. |
| 6,313,871 | B1 | 11/2001 | Schubert |
| 6,325,373 | B1 | 12/2001 | Breeding et al. |
| 6,334,614 | B1 | 1/2002 | Breeding |
| 6,341,778 | B1 | 1/2002 | Lee |
| 6,342,830 | B1 | 1/2002 | Want et al. |
| 6,346,044 | B1 | 2/2002 | McCrea, Jr. |
| 6,361,044 | B1 | 3/2002 | Block et al. |
| 6,386,973 | B1 | 5/2002 | Yoseloff |
| 6,402,142 | B1 | 6/2002 | Warren et al. |
| 6,446,864 | B1 | 9/2002 | Kim et al. |
| 6,454,266 | B1 | 9/2002 | Breeding et al. |
| 6,460,848 | B1 | 10/2002 | Soltys et al. |
| 6,464,584 | B2 | 10/2002 | Oliver |
| 6,490,277 | B1 | 12/2002 | Tzotzkov |
| 6,508,709 | B1 | 1/2003 | Karmarkar |
| 6,514,140 | B1 | 2/2003 | Storch |
| 6,517,435 | B2 | 2/2003 | Soltys et al. |
| 6,517,436 | B2 | 2/2003 | Soltys et al. |
| 6,527,271 | B2 | 3/2003 | Soltys et al. |
| 6,530,836 | B2 | 3/2003 | Soltys et al. |
| 6,530,837 | B2 | 3/2003 | Soltys et al. |
| 6,532,297 | B1 | 3/2003 | Lindquist |
| 6,533,276 | B2 | 3/2003 | Soltys et al. |
| 6,533,662 | B2 | 3/2003 | Soltys et al. |
| 6,543,770 | B1 | 4/2003 | Kaji et al. |
| 6,561,897 | B1 | 5/2003 | Bourbour et al. |
| 6,579,180 | B2 | 6/2003 | Soltys et al. |
| 6,579,181 | B2 | 6/2003 | Soltys et al. |
| 6,581,747 | B1 | 6/2003 | Charlier et al. |
| 6,582,301 | B2 | 6/2003 | Hill |
| 6,582,302 | B2 | 6/2003 | Romero |
| 6,585,586 | B1 | 7/2003 | Romero |
| 6,585,588 | B2 | 7/2003 | Hartl |
| 6,585,856 | B2 | 7/2003 | Zwick et al. |
| 6,588,750 | B1 | 7/2003 | Grauzer et al. |
| 6,588,751 | B1 | 7/2003 | Grauzer et al. |
| 6,595,857 | B2 | 7/2003 | Soltys et al. |
| 6,609,710 | B1 | 8/2003 | Order |
| 6,612,928 | B1 | 9/2003 | Bradford et al. |
| 6,616,535 | B1 | 9/2003 | Nishizaki et al. |
| 6,619,662 | B2 | 9/2003 | Miller |
| 6,622,185 | B1 | 9/2003 | Johnson et al. |
| 6,626,757 | B2 | 9/2003 | Oliveras |
| 6,629,019 | B2 | 9/2003 | Legge et al. |
| 6,629,591 | B1 | 10/2003 | Griswold et al. |
| 6,629,889 | B2 | 10/2003 | Mothwurf |
| 6,629,894 | B1 | 10/2003 | Purton |
| 6,637,622 | B1 | 10/2003 | Robinson |
| 6,645,068 | B1 | 11/2003 | Kelly et al. |
| 6,645,077 | B2 | 11/2003 | Rowe |
| 6,651,985 | B2 | 11/2003 | Sines et al. |
| 6,652,379 | B2 | 11/2003 | Soltys et al. |
| 6,655,690 | B1 | 12/2003 | Oskwarek |
| 6,658,135 | B1 | 12/2003 | Morito et al. |
| 6,659,460 | B2 | 12/2003 | Blaha et al. |
| 6,659,461 | B2 | 12/2003 | Yoseloff et al. |
| 6,659,875 | B2 | 12/2003 | Purton |
| 6,663,490 | B2 | 12/2003 | Soltys et al. |
| 6,666,768 | B1 | 12/2003 | Akers |
| 6,671,358 | B1 | 12/2003 | Seidman et al. |
| 6,676,517 | B2 | 1/2004 | Beavers |
| 6,680,843 | B2 | 1/2004 | Farrow et al. |
| 6,685,564 | B2 | 2/2004 | Oliver |
| 6,685,567 | B2 | 2/2004 | Cockerille et al. |
| 6,685,568 | B2 | 2/2004 | Soltys et al. |
| 6,688,597 | B2 | 2/2004 | Jones |
| 6,688,979 | B2 | 2/2004 | Soltys et al. |
| 6,690,673 | B1 | 2/2004 | Jarvis |
| 6,698,756 | B1 | 3/2004 | Baker et al. |
| 6,698,759 | B2 | 3/2004 | Webb et al. |
| 6,702,289 | B1 | 3/2004 | Feola |
| 6,702,290 | B2 | 3/2004 | Buono-Correa et al. |
| 6,709,333 | B1 | 3/2004 | Bradford et al. |
| 6,719,634 | B2 | 4/2004 | Mishina et al. |
| 6,722,974 | B2 | 4/2004 | Sines et al. |
| 6,726,205 | B1 | 4/2004 | Purton |
| 6,732,067 | B1 | 5/2004 | Powderly |
| 6,733,012 | B2 | 5/2004 | Bui et al. |
| 6,733,388 | B2 | 5/2004 | Mothwurf |
| 6,746,333 | B1 | 6/2004 | Onda et al. |
| 6,747,560 | B2 | 6/2004 | Stevens, III |
| 6,758,751 | B2 | 7/2004 | Soltys et al. |
| 6,758,757 | B2 | 7/2004 | Luciano et al. |
| 6,769,693 | B2 | 8/2004 | Huard et al. |
| 6,774,782 | B2 | 8/2004 | Runyon et al. |
| 6,789,801 | B2 | 9/2004 | Snow |
| 6,802,510 | B1 | 10/2004 | Haber |
| 6,804,763 | B1 | 10/2004 | Stockdale et al. |
| 6,808,173 | B2 | 10/2004 | Snow |
| 6,827,282 | B2 | 12/2004 | Silverbrook |
| 6,834,251 | B1 | 12/2004 | Fletcher |
| 6,840,517 | B2 | 1/2005 | Snow et al. |
| 6,842,263 | B1 | 1/2005 | Saeki |
| 6,843,725 | B2 | 1/2005 | Nelson |
| 6,848,616 | B2 | 2/2005 | Tsirline et al. |
| 6,848,844 | B2 | 2/2005 | McCue et al. |
| 6,848,994 | B1 | 2/2005 | Knust et al. |
| 6,857,961 | B2 | 2/2005 | Soltys et al. |
| 6,874,784 | B1 | 4/2005 | Promutico et al. |
| 6,874,786 | B2 | 4/2005 | Bruno et al. |
| 6,877,657 | B2 | 4/2005 | Ranard et al. |
| 6,877,748 | B1 | 4/2005 | Patroni et al. |
| 6,889,979 | B2 | 5/2005 | Blaha et al. |
| 6,893,347 | B1 | 5/2005 | Zilliacus et al. |
| 6,899,628 | B2 | 5/2005 | Leen et al. |
| 6,902,167 | B2 | 6/2005 | Webb |
| 6,905,121 | B1 | 6/2005 | Timpano |
| 6,923,446 | B2 | 8/2005 | Snow |
| 6,938,900 | B2 | 9/2005 | Snow |
| 6,941,180 | B1 | 9/2005 | Fischer et al. |
| 6,950,948 | B2 | 9/2005 | Neff |
| 6,955,599 | B2 | 10/2005 | Bourbour et al. |
| 6,957,746 | B2 | 10/2005 | Martin et al. |
| 6,959,925 | B1 | 11/2005 | Baker et al. |
| 6,960,134 | B2 | 11/2005 | Hartl et al. |
| 6,964,612 | B2 | 11/2005 | Soltys et al. |
| 6,986,514 | B2 | 1/2006 | Snow |
| 6,988,516 | B2 | 1/2006 | Debaes et al. |

(56) References Cited

U.S. PATENT DOCUMENTS

| | | | |
|---|---|---|---|
| 7,011,309 | B2 | 3/2006 | Soltys et al. |
| 7,020,307 | B2 | 3/2006 | Hinton et al. |
| 7,028,598 | B2 | 4/2006 | Teshima |
| 7,029,009 | B2 | 4/2006 | Grauzer et al. |
| 7,046,458 | B2 | 5/2006 | Nakayama |
| 7,046,764 | B1 | 5/2006 | Kump |
| 7,048,629 | B2 | 5/2006 | Sines et al. |
| 7,066,464 | B2 | 6/2006 | Blad et al. |
| 7,068,822 | B2 | 6/2006 | Scott |
| 7,079,010 | B2 | 7/2006 | Champlin |
| 7,084,769 | B2 | 8/2006 | Bauer et al. |
| 7,089,420 | B1 | 8/2006 | Durst et al. |
| D527,900 | S | 9/2006 | Dewa et al. |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,128,652 | B1 | 10/2006 | Lavoie et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,222,852 | B2 | 5/2007 | Soltys et al. |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,642 | B2 | 8/2007 | Sines et al. |
| 7,257,630 | B2 | 8/2007 | Cole et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,303,475 | B2 | 12/2007 | Britt et al. |
| 7,309,065 | B2 | 12/2007 | Yoseloff et al. |
| 7,316,609 | B2 | 1/2008 | Dunn et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| D566,784 | S | 4/2008 | Palmer |
| 7,357,321 | B2 | 4/2008 | Yoshida et al. |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,565 | B2 | 5/2008 | Chiu |
| 7,367,884 | B2 | 5/2008 | Breeding et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,399,226 | B2 | 7/2008 | Mishra |
| 7,407,438 | B2 | 8/2008 | Schubert et al. |
| 7,436,957 | B1 | 10/2008 | Fischer et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,478,813 | B1 | 1/2009 | Hofferber et al. |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida et al. |
| 7,575,237 | B2 | 8/2009 | Snow |
| 7,578,506 | B2 | 8/2009 | Lambert |
| 7,584,963 | B2 | 9/2009 | Krenn et al. |
| 7,584,966 | B2 | 9/2009 | Snow |
| 7,591,728 | B2 | 9/2009 | Gioia et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,853 | B2 | 3/2010 | Jones |
| 7,686,681 | B2 | 3/2010 | Soltys et al. |
| 7,740,244 | B2 | 6/2010 | Ho |
| 7,744,452 | B2 | 6/2010 | Cimring et al. |
| 7,753,374 | B2 | 7/2010 | Ho |
| 7,758,425 | B2 | 7/2010 | Poh et al. |
| 7,762,554 | B2 | 7/2010 | Ho |
| 7,766,332 | B2 | 8/2010 | Grauzer et al. |
| 7,766,333 | B1 | 8/2010 | Stardust et al. |
| 7,769,853 | B2 | 8/2010 | Nezamzadeh |
| 7,773,749 | B1 | 8/2010 | Durst et al. |
| 7,780,529 | B2 | 8/2010 | Rowe et al. |
| 7,784,790 | B2 | 8/2010 | Grauzer et al. |
| 7,804,982 | B2 | 9/2010 | Howard et al. |
| 7,824,255 | B2 | 11/2010 | Lutnick et al. |
| 7,846,020 | B2 | 12/2010 | Walker et al. |
| 7,890,365 | B2 | 2/2011 | Hettinger |
| 7,900,923 | B2 | 3/2011 | Toyama et al. |
| 7,908,169 | B2 | 3/2011 | Hettinger |
| 7,931,533 | B2 | 4/2011 | LeMay et al. |
| 7,946,586 | B2 | 5/2011 | Krenn et al. |
| 7,959,153 | B2 | 6/2011 | Franks, Jr. |
| 7,976,023 | B1 | 7/2011 | Hessing et al. |
| 7,988,554 | B2 | 8/2011 | LeMay et al. |
| 7,995,196 | B1 | 8/2011 | Fraser |
| 8,002,638 | B2 | 8/2011 | Grauzer et al. |
| 8,011,661 | B2 | 9/2011 | Stasson |
| 8,016,663 | B2 | 9/2011 | Soltys et al. |
| 8,021,231 | B2 | 9/2011 | Walker et al. |
| 8,025,294 | B2 | 9/2011 | Grauzer et al. |
| 8,038,521 | B2 | 10/2011 | Grauzer et al. |
| RE42,944 | E | 11/2011 | Blaha et al. |
| 8,057,302 | B2 | 11/2011 | Wells et al. |
| 8,062,134 | B2 | 11/2011 | Kelly et al. |
| 8,070,574 | B2 | 12/2011 | Grauzer et al. |
| 8,092,307 | B2 | 1/2012 | Kelly |
| 8,109,514 | B2 | 2/2012 | Toyama |
| 8,150,158 | B2 | 4/2012 | Downs, III |
| 8,171,567 | B1 | 5/2012 | Fraser et al. |
| 8,210,536 | B2 | 7/2012 | Blaha et al. |
| 8,251,293 | B2 | 8/2012 | Nagata et al. |
| 8,251,802 | B2 | 8/2012 | Snow |
| 8,270,603 | B1 | 9/2012 | Durst et al. |
| 8,287,347 | B2 | 10/2012 | Snow et al. |
| 8,287,386 | B2 | 10/2012 | Miller et al. |
| 8,319,666 | B2 | 11/2012 | Weinmann et al. |
| 8,342,525 | B2 | 1/2013 | Scheper et al. |
| 8,342,526 | B1 | 1/2013 | Sampson et al. |
| 8,342,529 | B2 | 1/2013 | Snow |
| 8,353,513 | B2 | 1/2013 | Swanson |
| 8,419,521 | B2 | 4/2013 | Grauzer et al. |
| 8,429,229 | B2 | 4/2013 | Sepich et al. |
| 8,444,489 | B2 | 5/2013 | Lian et al. |
| 8,475,252 | B2 | 7/2013 | Savage et al. |
| 8,498,444 | B2 | 7/2013 | Sharma |
| 8,505,916 | B2 | 8/2013 | Grauzer et al. |

(56) References Cited

U.S. PATENT DOCUMENTS 8,511,684 B2 8/2013 Grauzer et al.
8,512,146 B2 8/2013 Gururajan et al.
8,550,464 B2 10/2013 Soltys et al.
8,556,263 B2 10/2013 Grauzer et al.
8,579,289 B2 11/2013 Rynda et al.
RE44,616 E 12/2013 Blaha et al.
8,602,416 B2 12/2013 Toyama
8,616,552 B2 12/2013 Czyzewski et al.
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,820,745 B2 9/2014 Grauzer et al.
8,919,775 B2 12/2014 Wadds et al.
8,960,674 B2 2/2015 Stasson et al.
9,101,821 B2 8/2015 Snow
9,220,971 B2 12/2015 Rynda et al.
9,251,661 B2 2/2016 Tammesoo
9,266,012 B2 2/2016 Grauzer et al.
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,679,603 B2 6/2017 Kelly et al.
9,713,761 B2 7/2017 Sampson et al.
9,764,221 B2 9/2017 Swanson
9,901,810 B2 2/2018 Rynda et al.
9,908,034 B2 3/2018 Downs et al.
9,993,719 B2 6/2018 Krenn et al.
10,022,617 B2 7/2018 Stasson et al.
10,486,055 B2 * 11/2019 Kelly ..... A63F 1/12
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0073498 A1 4/2003 Grauzer et al.
2003/0075865 A1 4/2003 Grauzer et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0067789 A1 4/2004 Grauzer et al.
2004/0100026 A1 5/2004 Haggard
2004/0108255 A1 6/2004 Johnson
2004/0108654 A1 6/2004 Grauzer et al.
2004/0116179 A1 6/2004 Nicely et al.
2004/0169332 A1 * 9/2004 Grauzer ..... A63F 1/12
273/149 R
2004/0180722 A1 9/2004 Giobbi
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0026680 A1 2/2005 Gururajan
2005/0035548 A1 2/2005 Yoseloff et al.
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.
2005/0113166 A1 5/2005 Grauzer et al.
2005/0113171 A1 5/2005 Hodgson
2005/0119048 A1 6/2005 Soltys et al.
2005/0121852 A1 6/2005 Soltys et al.
2005/0137005 A1 6/2005 Soltys et al.
2005/0140090 A1 6/2005 Breeding et al.
2005/0148391 A1 7/2005 Tain
2005/0164759 A1 7/2005 Smith et al.
2005/0164761 A1 7/2005 Tain
2005/0192092 A1 9/2005 Breckner et al.
2005/0206077 A1 9/2005 Grauzer et al.
2005/0242500 A1 11/2005 Downs, III
2005/0272501 A1 12/2005 Tran et al.
2005/0277463 A1 12/2005 Knust et al.
2005/0288083 A1 12/2005 Downs, III
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0063577 A1 3/2006 Downs et al.
2006/0066048 A1 3/2006 Krenn et al.
2006/0084502 A1 4/2006 Downs et al.
2006/0151946 A1 7/2006 Ngai
2006/0181022 A1 8/2006 Grauzer et al.
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1 10/2006 Baker et al.
2006/0220313 A1 10/2006 Baker et al.
2006/0252521 A1 11/2006 Gururajan et al.
2006/0252554 A1 11/2006 Gururajan et al.
2006/0279040 A1 12/2006 Downs et al.
2007/0001395 A1 1/2007 Gioia et al.
2007/0015583 A1 1/2007 Tran
2007/0018389 A1 1/2007 Downs, III
2007/0045959 A1 3/2007 Soltys
2007/0049368 A1 3/2007 Kuhn et al.
2007/0057454 A1 3/2007 Fleckenstein
2007/0057469 A1 3/2007 Grauzer et al.
2007/0066387 A1 3/2007 Matsuno et al.
2007/0069462 A1 3/2007 Downs et al.
2007/0072677 A1 3/2007 Lavoie et al.
2007/0111773 A1 5/2007 Gururajan et al.
2007/0148283 A1 6/2007 Harvey et al.
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0222147 A1 9/2007 Blaha et al.
2007/0225055 A1 9/2007 Weisman
2007/0233567 A1 10/2007 Daly
2007/0238506 A1 10/2007 Ruckle
2007/0241498 A1 10/2007 Soltys
2007/0259709 A1 11/2007 Kelly et al.
2007/0267812 A1 11/2007 Grauzer et al.
2007/0272600 A1 11/2007 Johnson

(56) References Cited

U.S. PATENT DOCUMENTS

2007/0287534 A1 12/2007 Fleckenstein
2007/0290438 A1 12/2007 Grauzer et al.
2007/0298865 A1 12/2007 Soltys
2008/0004107 A1 1/2008 Nguyen et al.
2008/0022415 A1 1/2008 Kuo et al.
2008/0032763 A1 2/2008 Giobbi
2008/0039192 A1 2/2008 Laut
2008/0039208 A1 2/2008 Abrink et al.
2008/0096656 A1 4/2008 LeMay et al.
2008/0111300 A1 5/2008 Czyzewski et al.
2008/0113783 A1 5/2008 Czyzewski et al.
2008/0136108 A1 6/2008 Polay
2008/0143048 A1 6/2008 Shigeta
2008/0176627 A1 7/2008 Lardie
2008/0217218 A1 9/2008 Johnson
2008/0234046 A1 9/2008 Kinsley
2008/0234047 A1 9/2008 Nguyen
2008/0248875 A1 10/2008 Beatty
2008/0284096 A1 11/2008 Toyama et al.
2008/0315517 A1 12/2008 Toyama
2009/0026700 A2 1/2009 Shigeta
2009/0048026 A1 2/2009 French
2009/0054161 A1 2/2009 Schubert et al.
2009/0072477 A1 3/2009 Tseng
2009/0091078 A1 4/2009 Grauzer et al.
2009/0100409 A1 4/2009 Toneguzzo
2009/0104963 A1 4/2009 Burman et al.
2009/0121429 A1 5/2009 Walsh
2009/0134575 A1 5/2009 Dickinson et al.
2009/0140492 A1 6/2009 Yoseloff et al.
2009/0166970 A1 7/2009 Rosh
2009/0176547 A1 7/2009 Katz
2009/0179378 A1 7/2009 Amaitis et al.
2009/0186676 A1 7/2009 Amaitis et al.
2009/0191933 A1 7/2009 French
2009/0194988 A1 8/2009 Wright et al.
2009/0197662 A1 8/2009 Wright et al.
2009/0227318 A1 9/2009 Wright et al.
2009/0227360 A1 9/2009 Gioia et al.
2009/0250873 A1 10/2009 Jones
2009/0253478 A1 10/2009 Walker et al.
2009/0253503 A1 10/2009 Krise et al.
2009/0267297 A1 10/2009 Blaha et al.
2009/0283969 A1 11/2009 Tseng
2009/0298577 A1 12/2009 Gagner et al.
2009/0302535 A1 12/2009 Ho
2009/0302537 A1 12/2009 Ho
2009/0312093 A1 12/2009 Walker et al.
2009/0314188 A1 12/2009 Toyama et al.
2010/0013152 A1 1/2010 Grauzer et al.
2010/0038849 A1 2/2010 Scheper et al.
2010/0048304 A1 2/2010 Boesen
2010/0069155 A1 3/2010 Schwartz et al.
2010/0178987 A1 7/2010 Pacey
2010/0197410 A1 8/2010 Leen et al.
2010/0234110 A1 9/2010 Clarkson
2010/0240440 A1 9/2010 Szrek et al.
2010/0244376 A1 9/2010 Johnson
2010/0252992 A1 10/2010 Sines
2010/0255899 A1 10/2010 Paulsen
2010/0276880 A1 11/2010 Grauzer et al.
2010/0311493 A1 12/2010 Miller et al.
2010/0311494 A1 12/2010 Miller et al.
2010/0314830 A1 12/2010 Grauzer et al.
2010/0320685 A1 12/2010 Grauzer et al.
2011/0006480 A1 1/2011 Grauzer et al.
2011/0012303 A1 1/2011 Kourgiantakis et al.
2011/0024981 A1 2/2011 Tseng
2011/0052049 A1 3/2011 Rajaraman et al.
2011/0062662 A1 3/2011 Ohta et al.
2011/0078096 A1 3/2011 Bounds
2011/0079959 A1 4/2011 Hartley
2011/0105208 A1 5/2011 Bickley
2011/0130185 A1 6/2011 Walker
2011/0130190 A1 6/2011 Hamman et al.
2011/0159952 A1 6/2011 Kerr
2011/0159953 A1 6/2011 Kerr
2011/0165936 A1 7/2011 Kerr
2011/0172008 A1 7/2011 Alderucci
2011/0183748 A1 7/2011 Wilson et al.
2011/0230148 A1 9/2011 Demuynck et al.
2011/0230268 A1 9/2011 Williams
2011/0269529 A1 11/2011 Baerlocher
2011/0272881 A1 11/2011 Sines
2011/0285081 A1 11/2011 Stasson
2011/0287829 A1 11/2011 Clarkson et al.
2012/0015724 A1 1/2012 Ocko et al.
2012/0015725 A1 1/2012 Ocko et al.
2012/0015743 A1 1/2012 Lam et al.
2012/0015747 A1 1/2012 Ocko et al.
2012/0021835 A1 1/2012 Keller et al.
2012/0034977 A1 2/2012 Kammler
2012/0062745 A1 3/2012 Han et al.
2012/0074646 A1 3/2012 Grauzer et al.
2012/0091656 A1 4/2012 Blaha et al.
2012/0095982 A1 4/2012 Lennington et al.
2012/0161393 A1 6/2012 Krenn et al.
2012/0175841 A1 7/2012 Grauzer et al.
2012/0181747 A1 7/2012 Grauzer et al.
2012/0187625 A1 7/2012 Downs et al.
2012/0242782 A1 9/2012 Huang
2012/0286471 A1 11/2012 Grauzer et al.
2012/0306152 A1 12/2012 Krishnamurty et al.
2013/0020761 A1 1/2013 Sines et al.
2013/0023318 A1 1/2013 Abrahamson
2013/0026709 A1 1/2013 Sampson et al.
2013/0085638 A1 4/2013 Weinmann et al.
2013/0109455 A1 5/2013 Grauzer et al.
2013/0132306 A1 5/2013 Kami et al.
2013/0147116 A1 6/2013 Stasson
2013/0161905 A1 6/2013 Grauzer et al.
2013/0228972 A1 9/2013 Grauzer et al.
2013/0241147 A1 9/2013 McGrath
2013/0300059 A1 11/2013 Sampson et al.
2013/0337922 A1 12/2013 Kuhn et al.
2014/0027979 A1 1/2014 Stasson et al.
2014/0094239 A1 4/2014 Grauzer et al.
2014/0103606 A1 4/2014 Grauzer et al.
2014/0138907 A1 5/2014 Rynda et al.
2014/0145399 A1 5/2014 Krenn et al.
2014/0171170 A1 6/2014 Krishnamurty et al.
2014/0175724 A1 6/2014 Huhtala et al.
2014/0183818 A1 7/2014 Czyzewski et al.
2014/0346732 A1 11/2014 Blaha et al.
2015/0021242 A1 1/2015 Johnson
2015/0069699 A1 3/2015 Blazevic
2015/0196834 A1 7/2015 Scheper et al.
2015/0238848 A1 8/2015 Kuhn et al.
2015/0290528 A1 10/2015 Sampson et al.
2015/0290529 A1 10/2015 Bourbour et al.
2017/0157499 A1 6/2017 Krenn et al.
2018/0085658 A1 3/2018 Helsen et al.
2018/0089956 A1 3/2018 Nagaragatta et al.
2018/0200610 A1 7/2018 Riordan et al.

FOREIGN PATENT DOCUMENTS

AU 06978/05 B2 10/1998
AU 0757636 B2 2/2003
CA 2266555 A1 4/1998
CA 2284017 C 5/2006
CA 2612138 A1 12/2006
CN 2051521 U 1/1990
CN 1383099 A 12/2002
CN 1824356 A 8/2006
CN 2848303 Y 12/2006
CN 2855481 Y 1/2007
CN 1933881 A 3/2007
CN 2877425 Y 3/2007
CN 101025603 A 8/2007
CN 200954370 Y 10/2007
CN 200987893 Y 12/2007
CN 101099896 A 1/2008
CN 101127131 A 2/2008

(56) References Cited

FOREIGN PATENT DOCUMENTS

| | | | |
|---|---|---|---|
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CZ | 0024952 | U1 | 2/2013 |
| DE | 0291230 | C | 4/1916 |
| DE | 2757341 | A1 | 6/1978 |
| DE | 2816377 | A1 | 10/1979 |
| DE | 3807127 | A1 | 9/1989 |
| EP | 0777514 | B1 | 2/2000 |
| EP | 1194888 | A1 | 4/2002 |
| EP | 1502631 | A1 | 2/2005 |
| EP | 1713026 | A1 | 10/2006 |
| EP | 2228106 | A1 | 9/2010 |
| EP | 1575261 | B1 | 8/2012 |
| FR | 2375918 | A1 | 7/1978 |
| GB | 0289552 | A | 4/1928 |
| GB | 0337147 | A | 10/1930 |
| GB | 0414014 | A | 7/1934 |
| GB | 0672616 | A | 5/1952 |
| JP | 10-063933 | A | 3/1998 |
| JP | 11-045321 | A | 2/1999 |
| JP | 2000-251031 | A | 9/2000 |
| JP | 2001-327647 | A | 11/2001 |
| JP | 2002-165916 | A | 6/2002 |
| JP | 2003-154320 | A | 5/2003 |
| JP | 2003-250950 | A | 9/2003 |
| JP | 2005-198668 | A | 7/2005 |
| JP | 2008-246061 | A | 10/2008 |
| JP | 4586474 | B2 | 11/2010 |
| TW | M335308 | U | 7/2008 |
| TW | M357307 | U | 5/2009 |
| TW | M359356 | U | 6/2009 |
| TW | I345476 | B | 7/2011 |
| WO | 87/00764 | A1 | 2/1987 |
| WO | 92/21413 | A1 | 12/1992 |
| WO | 95/28210 | A1 | 10/1995 |
| WO | 96/07153 | A1 | 3/1996 |
| WO | 97/10577 | A1 | 3/1997 |
| WO | 98/14249 | A1 | 4/1998 |
| WO | 98/40136 | A1 | 9/1998 |
| WO | 99/43404 | A1 | 9/1999 |
| WO | 99/52610 | A1 | 10/1999 |
| WO | 99/52611 | A1 | 10/1999 |
| WO | 00/51076 | A1 | 8/2000 |
| WO | 01/56670 | A1 | 8/2001 |
| WO | 02/05914 | A1 | 1/2002 |
| WO | 01/78854 | A3 | 2/2002 |
| WO | 2003/004116 | A1 | 1/2003 |
| WO | 03/26763 | A1 | 4/2003 |
| WO | 2004/067889 | A1 | 8/2004 |
| WO | 2004/112923 | A1 | 12/2004 |
| WO | 2006/031472 | A2 | 3/2006 |
| WO | 06/39308 | A2 | 4/2006 |
| WO | 2007/117268 | A1 | 10/2007 |
| WO | 2008/005285 | A2 | 1/2008 |
| WO | 2008/005286 | A2 | 1/2008 |
| WO | 2008/006023 | A2 | 1/2008 |
| WO | 2008/091809 | A2 | 7/2008 |
| WO | 2009/067758 | A1 | 6/2009 |
| WO | 2009/137541 | A2 | 11/2009 |
| WO | 2010/052573 | A2 | 5/2010 |
| WO | 2010/055328 | A1 | 5/2010 |
| WO | 2010/117446 | A1 | 10/2010 |
| WO | 2012/053074 | A1 | 4/2012 |
| WO | 2013/019677 | A1 | 2/2013 |
| WO | 2016/058085 | A9 | 5/2016 |

OTHER PUBLICATIONS

"I-Deal," Bally Technologies, Inc., (2014), 2 pages.

"Playtech Retail begins roll out of Neon across Grosvenos 55 UK Casinos". Playtech, Apr. 21, 2016. Retrieved on Oct. 11, 2016 from the Internet: <URL: https://www.playtech.com/news/latest_news_and_prs/playtech_retail_begins_roll_out_of_neon_across_grosvenor_s_55_uk_casinos> (1 page).

"Shufflers—SHFL entertainment", Gaming Concepts Group, (2012), 6 pages.

"TableScanner (TM) from Advansys", Casino Inside Magazine, No. 30, pp. 34-36 (Dec. 2012) (4 pages).

1/3 B/W CCD Camera Module EB100 by EverFocus Electronics Corp., Jul. 31, 2001, 3 pgs.

ACE, Single Deck Shuffler, Shuffle Master, Inc., (2005), 2 pages.

Australian Provisional Patent Application for Australian Patent Application No. PM7441, filed Aug. 15, 1994, Applicants: Rodney G. Johnson et al., Title: Card Handling Apparatus, 13 pages.

Automatic casino card shuffle, Alibaba.com, (last visited Jul. 22, 2014), 2 pages.

Bally Systems Catalogue, Ballytech.com/systems, 2012, 13 pages.

CasinoTrac TableTrac Services. Product Information Dalasheet [online]. CasinoTrac, 2015. Retrieved on Oct. 12, 2016 from the Internet: <URL: http://www.tabletrac.com/?pageid=15#prettyPhoto> (3 pages).

Christos Stergiou and Dimitrios Siganos, "Neural Networks," http://www.doc.ic.ac.uk/~nd/surprise_96/journal/vol4/cs11/report.html (13 pages), Dec 15, 2011.

Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.

CONNECT2TABLE Administrator Manual, Jan. 7, 2013 (82 pages).

CONNECT2TABLE Connect2Table System Summary, generated Oct. 21, 2016 (2 pages).

CONNECT2TABLE Quick Installation Guide, Feb. 20, 2013 (36 pages).

CONNECT2TABLE User Manual, Feb. 7, 2013 (35 pages).

Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 18 of 23 color copies from Binder 1).

Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 19 of 23 color copies from Binder 3).

Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 20 of 23 color copies from Binder 4).

Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 21 of 23 color copies from Binder 6).

Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 22 of 23 color copies from Binder 8, part 1 of 2).

Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).

Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).

Documents submitted in case of *Shuffle Master, Inc.* v. *Card Austria, et al.*, Case No. CV-N-0508-HDM-(VPC) Consolidated with Case

(56) References Cited

OTHER PUBLICATIONS

No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *6Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
DVD labeled Exhibit 1. This is a DVD taken by Shuffle Master personnel of the live operation of a Card One2Six (Trademark) Shuffler (Oct. 7, 2003). DVD sent to Examiner by US Postal Service with this PTO/SB/08 form.
DVD labeled Luciano Decl. Ex. K is (see Binder 2-1, p. 215/237, Luciano Decl., para.14): A video demonstration (11minutes) of a Luciano Packaging prototype shuffler. DVD sent to Examiner by US Postal Service with this PTO/SB/08 form.
DVD labeled Morrill Decl. Ex. A is (see Binder 4-1, p. 149/206, Morrill Deck, para. 2.): A video (16 minutes) that the attorney for CARD, Robert Morrill, made to describe the Roblejo prototype card shuffler. DVD sent to Examiner by US Postal Service with this PTO/SB/08 form.
DVD labeled Solberg Decl. Ex. C, which is not a video at all, is (see Binder 4-1, p. 34/206, Solberg Deck, para.8): Computer source code for operating a computer-controlled card shuffler (an early Roblejo prototype card shuffler) and Descriptive comments of how the code works. DVD sent to Examiner by US Postal Service with this PTO/SB/08 form.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may-2012/article/talking-tables> (4 pages).
Genevieve Orr, CS-449: Neural Networks Willamette University, http://www.willamette.edu/~gorr/classes/cs449/intro.html (4 pages), Fall 1999.
Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231,290-315, 411; Henderson Legal Services, Inc.; Washington, DC.
Gros, Roger; New Card Management System to be Tested at Bally's Park Place; Casino Journal; Apr. 1989; 5 pages.
http://www.google.com/search?tbm=pts&q=Card+handling+device+with+input+and- +outpu . . . , Jun. 8, 2012.
http://www.google.com/search?tbm=pts&q=shuffling+zone+onOopposite+site+of+input+ . . . Jul. 18, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
Litwiller, Dave, CCD vs. CMOS: Facts and Fiction reprinted from Jan. 2001 Issue of Photonics Spectra, Laurin Publishing Co. Inc. (4 pages).
Neon Product Information Datasheets [online]. "Enterprise Casino Management, Table Management System, Mobile, Gaming". Intelligent Gaming, 2014. Retrieved on Oct. 12, 2016 from the Internet: <URL: http://www.intelligentgaming.co.uk/products/neon-enterprise/> (4 pages).
Olsen, Eddie; Automatic Shuffler 'ready' for Atlantic City experiment; Blackjack Confidential; Jul./Aug. 1989; pp. 6-7.
PCT International Search Report and Written Opinion, PCT Application No. PCT/US2015/051038, dated Jan. 22, 2016, 11 pages.
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Prototype Glossary and Timelines; *Shuffle Tech International* v. *Scientific Games Corp., et al.* 1:15-cv-3702 (N.D. III.); (May 2017) pp. 1-4.
Scame's Encyclopedia of Games by John Scarne, 1973, "Super Contract Bridge", p. 153.
Service Manual/User Manual for Single Deck Shufflers: BG1, BG2 and BG3 by Shuffle Master (copyright) 1997, 151 page.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master Gaming, Service Manual, ACE(trademark) Single Deck Card Shuffler, (1998), 63 pages.
Shuffle Master Gaming, Service Manual, Let It Ride Bonus (Register) With Universal Keypad, 112 pages, (Copyright) 2000 Shuffle Master, Inc.
Shuffle Master's Reply Memorandum in Support of Shuffle Master's Motion for Preliminary Injunction for *Shuffle Master, Inc.* vs. *VendingData Corporation*, In the U.S. District Court, District of Nevada, No. CV-S-04-1373-JCM-LRL, Nov. 29, 2004.
Shuffle Master, Inc. (1996) Let It Ride, The Tournament, User Guide, 72 pages.
*Shuffle Tech International LLC et al.* vs. *Scientific Games Corporation et al.*, Order Denying Motion for Summary Judgement:

(56) References Cited

OTHER PUBLICATIONS

Memorandum Opinion and Order, In the U.S. District Court, for the Northern District of Illinois Eastern Division, No. 15 C 3702, Sep. 1, 2017, 35 pages.
Solberg, Halvard; Deposition; *Shuffle Tech International* v. *Scientific Games Corp., et al*. 1:15-cv-3702 (N.D. III.); Oct. 18, 2016; pp. 187, 224-246, 326-330, 338-339, 396; Baytowne Reporting; Panama City, FL.
Statement of Relevance of Cited References, Submitted as Part of a Third-Party Submission Under 37 CFR 1.290 on Dec. 7, 2012 (12 pages).
TableScanner "Accounting & Cage". Product Information Datasheets [online]. Advansys, 2013. Retrieved on Oct. 11, 2016 from the Internet: <URL: http://advansys.si/products/tablescanner/accounting-cage/> (4 pages).
TableScanner "Casino Management System". Product Information Datasheets [online]. Advansys, 2013. Retrieved on Oct. 11, 2016 from the Internet: <URL: http://advansys.si/> (6 pages).
TableScanner "Multisite". Product Information Datasheets [online]. Advansys, 2013. Retrieved on Oct. 11, 2016 from the Internet: <URL: http://advansys.si/products/tablescanner/multisite/> (3 pages).
TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).
TableScanner "Table Management system". Product Information Datasheets [online]. Advansys, 2013. Retrieved on Oct. 11, 2016 from the Internet: <URL: http://advansys.si/products/tablescanner/> (4 pages).
TAG Archives: Shuffle Machine, Gee Wiz Online, (Mar. 25, 2013), 4 pages.
Taiwanese Office Action and Search Report from Taiwanese Application No. 10410643, dated Oct. 4, 2018, 15 pages.
tbm=pts&hl=en Google Search for card handling device with storage area, card removing system pivoting arm and processor http://www.google.com/?tbm=pts&hl=en; Jul. 28, 2012, 2 pages.
Tracking the Tables, by Jack Bularsky, Casino Journal, May 2004, vol. 17, No. 5, pp. 44-47.
TYM @ A Glance—Table Games Yield Management, TYM Live Product Information Datasheets [online]. TANGAM Systems, 2016. Retrieved on Oct. 3, 2016 from the Internet: <URL: http://tangamgaming.com/wp-content/uploads/2016/12/TG_TYMGlance_2016-V4-1.pdf> (2 pages).
United States Court of Appeals for the Federal Circuit Decision Decided Dec. 27, 2005 for Preliminary Injuction for *Shuffle Master, Inc*. vs. *VendingData Corporation*, in the U.S. District Court, District of Nevada, No. CV-S-04-1373-JCM-LRL.
VendingData Corporation's Answer and Counterclaim Jury Trial Demanded for *Shuffle Master, Inc*. vs. *VendingData Corporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc*. vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc*. vs. *VendingData Corporation*, In the U.S. District Court, District of Nevada, No. CV-S-04-1373-JCM-LRL, Mar. 14, 2005.
Weisenfeld, Bernie; Inventor betting on shuffler; Courier-Post; Sep. 11, 1990; 1 page.

* cited by examiner

500

504

| | 1 | 5 | 10 | 25 | 45 | 55 | 65 | 80 | 90 | 100 |
|---|---|---|---|---|---|---|---|---|---|---|
| AVERAGE | 11253.33 | 11140.67 | 11017 | 10633.33 | 10136.67 | 9881.667 | 9651 | 9289 | 9040.333 | 8805.333 |
| | | | | | | | | | | |
| | | | | | | | | | | |
| | | | | | | | | | | |
| 1 | 11234 | 11244 | 11244 | 11246 | 11252 | 11253 | 11255 | 11259 | 11262 | 11264 |
| 5 | 11127 | 11134 | 11135 | 11139 | 11140 | 11141 | 11141 | 11141 | 11142 | 11144 |
| 10 | 11005 | 11006 | 11007 | 11013 | 11013 | 11018 | 11020 | 11020 | 11021 | 11022 |
| 25 | 10614 | 10619 | 10624 | 10628 | 10633 | 10633 | 10634 | 10641 | 10645 | 10648 |
| 45 | 10092 | 10107 | 10121 | 10122 | 10133 | 10136 | 10141 | 10144 | 10150 | 10153 |
| 55 | 9856 | 9871 | 9873 | 9874 | 9878 | 9883 | 9884 | 9888 | 9899 | 9901 |
| 65 | 9623 | 9625 | 9628 | 9642 | 9647 | 9647 | 9659 | 9660 | 9664 | 9676 |
| 80 | 9244 | 9256 | 9266 | 9273 | 9288 | 9289 | 9290 | 9294 | 9297 | 9300 |
| 90 | 8998 | 9021 | 9028 | 9033 | 9033 | 9044 | 9044 | 9046 | 9049 | 9065 |
| 100 | 8754 | 8795 | 8799 | 8800 | 8803 | 8805 | 8808 | 8808 | 8810 | 8814 |
| | | | | | | | | | | |
| | | | | | | | | | | |
| | 1 | 2 | 3 | 4 | 5 | 6 | 7 | 8 | 9 | 10 |
| 1 | -19.334 | -9.334 | -9.334 | -7.334 | -1.334 | -0.334 | 1.666 | 5.666 | 8.666 | 10.666 |
| 5 | -13.666 | -6.666 | -5.666 | -1.666 | -0.666 | 0.334 | 0.334 | 0.334 | 1.334 | 3.334 |
| 10 | -12 | -11 | -10 | -4 | -4 | 1 | 3 | 3 | 4 | 5 |
| 25 | -19.334 | -14.334 | -9.334 | -5.334 | -0.334 | -0.334 | 0.666 | 7.666 | 11.666 | 14.666 |
| 45 | -44.667 | -29.667 | -15.667 | -14.667 | -3.667 | -0.667 | 4.333 | 7.333 | 13.333 | 16.333 |
| 55 | -25.667 | -10.667 | -8.667 | -7.667 | -3.667 | 1.333 | 2.333 | 6.333 | 17.333 | 19.333 |
| 65 | -28 | -26 | -23 | -9 | -4 | -4 | 8 | 9 | 13 | 25 |
| 80 | -45 | -33 | -23 | -16 | -1 | 0 | 1 | 5 | 8 | 11 |
| 90 | -42.333 | -19.333 | -12.333 | -7.333 | -7.333 | 3.667 | 3.667 | 5.667 | 8.667 | 24.667 |
| 100 | -51.333 | -10.333 | -6.333 | -5.333 | -2.333 | -0.333 | 2.667 | 2.667 | 4.667 | 8.667 |

502

506

FIG. 5

1200

| | ON PLATFORM | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| | 2 | 3 | 4 | 5 | 6 | 7 | 8 | 10 | 12 | 14 | 16 | 18 | 20 | 25 | 30 | 35 | 40 | 45 | 50 | 55 | 60 | 70 | 80 | 90 | 110 | 150 | 224 | 344 | 404 | 464 | 480 |
| CORRECTION TABLE GRIP 003 | -20 | -34 | -7 | -14 | -36 | -12 | -24 | -26 | -33 | -27 | -29 | -21 | -3 | -6 | -13 | 8 | -18 | -16 | -24 | -22 | -20 | -27 | -24 | -31 | -29 | 0 | 0 | 0 | 0 | 0 | 0 |
| CORRECTION TABLE GRIP 004 | -17 | -8 | -13 | -12 | -27 | -2 | -16 | -2 | 12 | -19 | -34 | -24 | -22 | 0 | -11 | -10 | 0 | -21 | -19 | -17 | -23 | -22 | -25 | -31 | -29 | 0 | 0 | 0 | 0 | 0 | 0 |
| CORRECTION TABLE GRIP 005 | -30 | -12 | -39 | -5 | -16 | -17 | -16 | -11 | -23 | 0 | -12 | -25 | 16 | -7 | -20 | -13 | -28 | -21 | -25 | -19 | -20 | -25 | -28 | -30 | -33 | 0 | 0 | 0 | 0 | 0 | 0 |
| CORRECTION TABLE GRIP 006 | -20 | -13 | -11 | 3 | -11 | -17 | -13 | -13 | -12 | -9 | -18 | -28 | -12 | -11 | -14 | -6 | -9 | -20 | -15 | -18 | -27 | -28 | -33 | -23 | -31 | 0 | 0 | 0 | 0 | 0 | 0 |
| CORRECTION TABLE GRIP 007 | -11 | -8 | -20 | 0 | -25 | -29 | -12 | -7 | -14 | -8 | -9 | -9 | -23 | -22 | -5 | -15 | -14 | -21 | -14 | -22 | 0 | -15 | -20 | -35 | -17 | 0 | 0 | 0 | 0 | 0 | 0 |
| CORRECTION TABLE GRIP 008 | -7 | -15 | -12 | -5 | -17 | -4 | -20 | -13 | -23 | -8 | -8 | -15 | -14 | -14 | -17 | -13 | -21 | 0 | -18 | -20 | -27 | -24 | -27 | -37 | 0 | 0 | 0 | 0 | 0 | 0 | 0 |
| CORRECTION TABLE GRIP 009 | -4 | -15 | -11 | -7 | -18 | -20 | -26 | -13 | -13 | -23 | 1 | -14 | -13 | -4 | -13 | -15 | -8 | -28 | -17 | -15 | -33 | -31 | -28 | -9 | -16 | 0 | 0 | 0 | 0 | 0 | 0 |
| CORRECTION TABLE GRIP 011 | -11 | -16 | -13 | -13 | -22 | -13 | -7 | -5 | -10 | -8 | -7 | -15 | -13 | -12 | -12 | -7 | -20 | -15 | -22 | -27 | -27 | -27 | -16 | -23 | -34 | 0 | 0 | 0 | 0 | 0 | 0 |
| CORRECTION TABLE GRIP 013 | 2 | -10 | -4 | -12 | 7 | -3 | -17 | 8 | -17 | -3 | -16 | -24 | -11 | -3 | -4 | -14 | -9 | -20 | -20 | -15 | -23 | -11 | -15 | -23 | -12 | 0 | 0 | 0 | 0 | 0 | 0 |
| CORRECTION TABLE GRIP 017 | -10 | -1 | -12 | -1 | -13 | -7 | -7 | -10 | -1 | -3 | -2 | -9 | -8 | -6 | -2 | -11 | -2 | -4 | -13 | -14 | -18 | -16 | -18 | -17 | 0 | 0 | 0 | 0 | 0 | 0 | 0 |
| CORRECTION TABLE GRIP 019 | -10 | -1 | -8 | 5 | -5 | -2 | -6 | -9 | -9 | -10 | -6 | -14 | -12 | 5 | -2 | -9 | -1 | -18 | -9 | -14 | -13 | -7 | -21 | -12 | 0 | 0 | 0 | 0 | 0 | 0 | 0 |
| CORRECTION TABLE GRIP 021 | -3 | 0 | 5 | 4 | -3 | -15 | -2 | 0 | 1 | 1 | -3 | -7 | -5 | -4 | 3 | -2 | 0 | -13 | -12 | -13 | -8 | -10 | -18 | -23 | 0 | 0 | 0 | 0 | 0 | 0 | 0 |
| CORRECTION TABLE GRIP 025 | -18 | -6 | 13 | 1 | -3 | 4 | -8 | -4 | -8 | 1 | 6 | 5 | 4 | 12 | 8 | -1 | -8 | -11 | -16 | -10 | -11 | -8 | -8 | 0 | 0 | 0 | 0 | 0 | 0 | 0 | 0 |
| CORRECTION TABLE GRIP 030 | 2 | 8 | -3 | -2 | 2 | 4 | -2 | 7 | -2 | 5 | -1 | 5 | 8 | 1 | 5 | 7 | -3 | -8 | -8 | -4 | -3 | -4 | -4 | 0 | 0 | 0 | 0 | 0 | 0 | 0 | 0 |
| CORRECTION TABLE GRIP 035 | 1 | -1 | 17 | 11 | -4 | 8 | 5 | 3 | -1 | 4 | 16 | 8 | 8 | 0 | 5 | -5 | -9 | -13 | -5 | -7 | -4 | 5 | -22 | 0 | 0 | 0 | 0 | 0 | 0 | 0 | 0 |
| CORRECTION TABLE GRIP 040 | 10 | 21 | -7 | -13 | 16 | -15 | 16 | 11 | 2 | 11 | 0 | 1 | 11 | -2 | 8 | 3 | -1 | 5 | -6 | -10 | -8 | -3 | 0 | 0 | 0 | 0 | 0 | 0 | 0 | 0 | 0 |
| CORRECTION TABLE GRIP 045 | 0 | 8 | 4 | -2 | -7 | -5 | 5 | 0 | 11 | 4 | 7 | 4 | -7 | -7 | 4 | -1 | -10 | -9 | -9 | -2 | -8 | -27 | 0 | 0 | 0 | 0 | 0 | 0 | 0 | 0 | 0 |
| CORRECTION TABLE GRIP 050 | 9 | 3 | 4 | 15 | 1 | 3 | 12 | 0 | 4 | 4 | 3 | -3 | 0 | -3 | 1 | -1 | -4 | -3 | 0 | -8 | -7 | 0 | 0 | 0 | 0 | 0 | 0 | 0 | 0 | 0 | 0 |
| CORRECTION TABLE GRIP 055 | 0 | 2 | 5 | 1 | 14 | 4 | -5 | -4 | 1 | -2 | 1 | 2 | -5 | -2 | 2 | -5 | 4 | 4 | -8 | -10 | 0 | 0 | 0 | 0 | 0 | 0 | 0 | 0 | 0 | 0 | 0 |
| CORRECTION TABLE GRIP 060 | 6 | 12 | 12 | 13 | 1 | -4 | 3 | 6 | 7 | 4 | 2 | 3 | 3 | -3 | -7 | 10 | 8 | 0 | -14 | 0 | 0 | 0 | 0 | 0 | 0 | 0 | 0 | 0 | 0 | 0 | 0 |
| CORRECTION TABLE GRIP 065 | 0 | 10 | 20 | 10 | 0 | 9 | 11 | 8 | 35 | 4 | 3 | 5 | -3 | 5 | 8 | 2 | 9 | -5 | 0 | 0 | 0 | 0 | 0 | 0 | 0 | 0 | 0 | 0 | 0 | 0 | 0 |
| CORRECTION TABLE GRIP 070 | 3 | 10 | 0 | 19 | 5 | 1 | 4 | 13 | 6 | 11 | 11 | 5 | -2 | 5 | 2 | 6 | 3 | 0 | 0 | 0 | 0 | 0 | 0 | 0 | 0 | 0 | 0 | 0 | 0 | 0 | 0 |
| CORRECTION TABLE GRIP 080 | 15 | 10 | 23 | 21 | 6 | 2 | 13 | 16 | 13 | 15 | 17 | 9 | 11 | 4 | -2 | -9 | 0 | 0 | 0 | 0 | 0 | 0 | 0 | 0 | 0 | 0 | 0 | 0 | 0 | 0 | 0 |
| CORRECTION TABLE GRIP 090 | 25 | 18 | 5 | 21 | 14 | 12 | 11 | 9 | 8 | 13 | 10 | 6 | 6 | -6 | 0 | 0 | 0 | 0 | 0 | 0 | 0 | 0 | 0 | 0 | 0 | 0 | 0 | 0 | 0 | 0 | 0 |
| CORRECTION TABLE GRIP 110 | 18 | 18 | 16 | 12 | 0 | 29 | 20 | 10 | 20 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| CORRECTION TABLE GRIP 150 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| CORRECTION TABLE GRIP 224 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| CORRECTION TABLE GRIP 344 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| CORRECTION TABLE GRIP 404 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| CORRECTION TABLE GRIP 464 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| CORRECTION TABLE GRIP 480 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 12

1300

| | ON PLATFORM | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| | 2 | 3 | 4 | 5 | 6 | 7 | 8 | 10 | 12 | 14 | 16 | 18 | 20 | 25 | 30 | 35 | 40 | 45 | 50 | 55 | 60 | 70 | 80 | 90 | 110 | 150 | 224 | 344 | 404 | 464 | 480 |
| INSERT ZONE HITS GRIP 003 | 12 | 9 | 10 | 25 | 6 | 26 | 17 | 25 | 5 | 3 | 23 | 25 | 6 | 25 | 25 | 6 | 17 | 25 | 25 | 12 | 5 | 25 | 25 | 7 | 21 | | | | | | |
| INSERT ZONE HITS GRIP 004 | 6 | 23 | 21 | 9 | 20 | 14 | 16 | 12 | 7 | 12 | 4 | 16 | 7 | 1 | 24 | 6 | 6 | 15 | 21 | 19 | 13 | 23 | 3 | 25 | 9 | | | | | | |
| INSERT ZONE HITS GRIP 005 | 7 | 13 | 8 | 12 | 12 | 9 | 15 | 23 | 11 | 1 | 13 | 12 | 13 | 25 | 21 | 13 | 3 | 18 | 22 | 10 | 4 | 25 | 17 | 9 | 14 | | | | | | |
| INSERT ZONE HITS GRIP 006 | 7 | 15 | 12 | 16 | 15 | 14 | 1 | 16 | 8 | 17 | 21 | 5 | 10 | 14 | 21 | 24 | 25 | 21 | 19 | 8 | 14 | 9 | 12 | 10 | 12 | | | | | | |
| INSERT ZONE HITS GRIP 007 | 23 | 22 | 13 | 1 | 10 | 16 | 12 | 18 | 11 | 14 | 25 | 17 | 16 | 24 | 25 | 16 | 25 | 19 | 9 | 14 | 1 | 12 | 22 | 20 | 10 | | | | | | |
| INSERT ZONE HITS GRIP 008 | 25 | 20 | 14 | 19 | 11 | 25 | 13 | 22 | 14 | 24 | 9 | 17 | 23 | 25 | 19 | 25 | 3 | 2 | 21 | 5 | 20 | 5 | 25 | 16 | 2 | | | | | | |
| INSERT ZONE HITS GRIP 009 | 19 | 7 | 6 | 13 | 9 | 6 | 6 | 25 | 13 | 11 | 9 | 9 | 20 | 10 | 16 | 19 | 25 | 19 | 25 | 12 | 13 | 15 | 16 | 15 | 5 | | | | | | |
| INSERT ZONE HITS GRIP 011 | 25 | 25 | 25 | 25 | 25 | 19 | 12 | 25 | 21 | 25 | 20 | 25 | 18 | 25 | 25 | 25 | 25 | 25 | 25 | 23 | 20 | 25 | 25 | 25 | 7 | | | | | | |
| INSERT ZONE HITS GRIP 013 | 23 | 22 | 25 | 16 | 19 | 14 | 10 | 25 | 12 | 25 | 25 | 23 | 25 | 25 | 25 | 25 | 25 | 25 | 25 | 25 | 25 | 25 | 25 | 25 | 1 | | | | | | |
| INSERT ZONE HITS GRIP 017 | 16 | 25 | 20 | 25 | 25 | 25 | 20 | 25 | 25 | 25 | 25 | 25 | 25 | 25 | 25 | 25 | 25 | 25 | 25 | 25 | 25 | 25 | 25 | 25 | | | | | | | |
| INSERT ZONE HITS GRIP 019 | 5 | 17 | 24 | 6 | 19 | 16 | 15 | 14 | 25 | 25 | 17 | 12 | 20 | 25 | 25 | 25 | 25 | 25 | 22 | 19 | 25 | 25 | 25 | 11 | | | | | | | |
| INSERT ZONE HITS GRIP 021 | 13 | 5 | 20 | 23 | 9 | 11 | 9 | 24 | 18 | 21 | 25 | 18 | 20 | 25 | 25 | 25 | 15 | 25 | 22 | 17 | 22 | 25 | 25 | 2 | | | | | | | |
| INSERT ZONE HITS GRIP 025 | 18 | 24 | 25 | 18 | 25 | 23 | 18 | 25 | 25 | 25 | 25 | 25 | 25 | 25 | 25 | 25 | 25 | 25 | 25 | 25 | 25 | 25 | 25 | | | | | | | | |
| INSERT ZONE HITS GRIP 030 | 21 | 25 | 25 | 25 | 21 | 15 | 16 | 25 | 25 | 25 | 25 | 25 | 25 | 25 | 25 | 25 | 25 | 25 | 25 | 25 | 25 | 25 | 25 | | | | | | | | |
| INSERT ZONE HITS GRIP 035 | 17 | 25 | 20 | 25 | 11 | 25 | 25 | 25 | 25 | 25 | 25 | 25 | 25 | 25 | 25 | 25 | 25 | 25 | 25 | 25 | 25 | 25 | 9 | | | | | | | | |
| INSERT ZONE HITS GRIP 040 | 7 | 25 | 16 | 17 | 22 | 4 | 12 | 25 | 25 | 25 | 25 | 25 | 25 | 25 | 25 | 25 | 25 | 25 | 25 | 25 | 25 | 25 | | | | | | | | | |
| INSERT ZONE HITS GRIP 045 | 5 | 20 | 20 | 11 | 18 | 13 | 20 | 25 | 25 | 25 | 25 | 25 | 20 | 25 | 25 | 25 | 25 | 25 | 25 | 25 | 25 | 6 | | | | | | | | | |
| INSERT ZONE HITS GRIP 050 | 14 | 10 | 25 | 23 | 25 | 13 | 8 | 20 | 25 | 25 | 22 | 19 | 24 | 25 | 25 | 25 | 25 | 25 | 25 | 25 | 5 | | | | | | | | | | |
| INSERT ZONE HITS GRIP 055 | 11 | 8 | 10 | 12 | 13 | 21 | 6 | 25 | 25 | 21 | 15 | 16 | 24 | 25 | 25 | 25 | 25 | 25 | 25 | 4 | | | | | | | | | | | |
| INSERT ZONE HITS GRIP 060 | 11 | 18 | 21 | 10 | 18 | 19 | 23 | 25 | 25 | 25 | 15 | 25 | 18 | 25 | 25 | 25 | 25 | 25 | 3 | | | | | | | | | | | | |
| INSERT ZONE HITS GRIP 065 | 9 | 7 | 18 | 18 | 13 | 20 | 12 | 23 | 14 | 25 | 23 | 25 | 19 | 25 | 25 | 25 | 25 | 3 | | | | | | | | | | | | | |
| INSERT ZONE HITS GRIP 070 | 16 | 14 | 8 | 7 | 12 | 10 | 18 | 25 | 19 | 25 | 20 | 24 | 15 | 25 | 25 | 25 | 16 | | | | | | | | | | | | | | |
| INSERT ZONE HITS GRIP 080 | 24 | 21 | 25 | 14 | 25 | 25 | 25 | 25 | 25 | 25 | 25 | 25 | 25 | 25 | 25 | 4 | | | | | | | | | | | | | | | |
| INSERT ZONE HITS GRIP 090 | 25 | 24 | 25 | 25 | 25 | 18 | 22 | 25 | 25 | 25 | 25 | 20 | 11 | 7 | | | | | | | | | | | | | | | | | |
| INSERT ZONE HITS GRIP 110 | 25 | 23 | 19 | 19 | 4 | 12 | 9 | 15 | 4 | | | | | | | | | | | | | | | | | | | | | | |
| INSERT ZONE HITS GRIN 150 | | | | | | | | | | | | | | | | | | | | | | | | | | | | | | | |

FIG. 13

1400

| | ON PLATFORM | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| | 2 | 3 | 4 | 5 | 6 | 7 | 8 | 10 | 12 | 14 | 16 | 18 | 20 | 25 | 30 | 35 | 40 | 45 | 50 | 55 | 60 | 70 | 80 | 90 | 110 | 150 | 224 | 344 | 404 | 464 | 480 |
| TOTAL ZONE RETRYS GRIP 003 | 16 | -6 | -15 | 10 | -4 | -7 | -6 | 6 | -12 | -6 | 2 | 1 | -10 | 6 | | -2 | -4 | -2 | -12 | -6 | | 4 | -5 | -8 | -1 | | | | | | |
| TOTAL ZONE RETRYS GRIP 004 | -3 | 2 | | 9 | | 2 | 2 | 3 | -4 | -5 | -2 | -1 | 1 | -5 | 3 | 6 | -15 | -8 | 1 | -2 | -1 | -10 | -2 | -8 | -8 | | | | | | |
| TOTAL ZONE RETRYS GRIP 005 | 6 | 5 | -10 | -5 | -2 | -3 | 4 | -4 | -3 | 3 | | -5 | -4 | 2 | 2 | -4 | 2 | -2 | 4 | -5 | -2 | -3 | -3 | | -4 | | | | | | |
| TOTAL ZONE RETRYS GRIP 006 | -5 | 2 | -3 | 3 | 2 | -1 | | 1 | 4 | -6 | -5 | -1 | -4 | -1 | | 2 | -3 | | 1 | -10 | -2 | -2 | 1 | -6 | 2 | | | | | | |
| TOTAL ZONE RETRYS GRIP 007 | -2 | 8 | -3 | 2 | 3 | 5 | -2 | | | 3 | 4 | 3 | 7 | -4 | 8 | -2 | -2 | -5 | -6 | -11 | 2 | -15 | -2 | -5 | | | | | | | |
| TOTAL ZONE RETRYS GRIP 008 | | -5 | 2 | -1 | -3 | | -1 | 1 | -9 | 4 | | -5 | 4 | -1 | -4 | 2 | -4 | 2 | -1 | -4 | | -6 | -2 | -8 | | | | | | | |
| TOTAL ZONE RETRYS GRIP 009 | 1 | -1 | 1 | 4 | -3 | -4 | -5 | 6 | -4 | -1 | | -4 | -4 | -6 | -7 | -1 | 9 | -5 | -7 | -2 | -7 | -5 | -4 | 2 | -1 | | | | | | |
| TOTAL ZONE RETRYS GRIP 011 | 5 | | 6 | 4 | 4 | 1 | | | 1 | 5 | -3 | 8 | -2 | -2 | 6 | 5 | -2 | 4 | -5 | -5 | 1 | 19 | 2 | -6 | | | | | | | |
| TOTAL ZONE RETRYS GRIP 013 | 1 | | 2 | -3 | 6 | -2 | | 5 | -2 | 3 | 2 | 5 | 3 | | | 4 | 4 | -2 | -5 | -8 | -4 | | -1 | | | | | | | | |
| TOTAL ZONE RETRYS GRIP 017 | -2 | 1 | 3 | 3 | -4 | 2 | 3 | 2 | 5 | 3 | 7 | 3 | 5 | 3 | | 3 | -2 | 7 | 3 | 6 | 11 | 3 | 4 | -14 | | | | | | | |
| TOTAL ZONE RETRYS GRIP 019 | | -1 | -1 | | | 6 | 6 | 2 | 4 | 5 | -2 | 1 | -1 | 2 | -1 | 3 | 2 | -3 | -2 | 1 | 1 | 2 | | -1 | | | | | | | |
| TOTAL ZONE RETRYS GRIP 021 | 1 | | -5 | -1 | | 1 | -4 | 5 | -6 | 3 | 2 | 3 | -4 | 3 | 5 | 1 | -6 | -2 | | -2 | 1 | | -6 | -1 | | | | | | | |
| TOTAL ZONE RETRYS GRIP 025 | 1 | 4 | -10 | -1 | 3 | 6 | 1 | 2 | 2 | -3 | 4 | 6 | 8 | 2 | -10 | -4 | -1 | 2 | | 10 | -1 | -7 | -1 | | | | | | | | |
| TOTAL ZONE RETRYS GRIP 030 | 1 | 3 | 4 | 10 | -3 | 4 | | 6 | 4 | 5 | -5 | -4 | 11 | | -4 | -3 | -4 | 3 | 9 | -4 | 3 | 5 | 11 | | | | | | | | |
| TOTAL ZONE RETRYS GRIP 035 | 1 | 5 | 3 | 5 | -2 | 10 | 7 | -2 | | 3 | 8 | 6 | 6 | 7 | 6 | -7 | 5 | -4 | 2 | -3 | | 2 | -2 | | | | | | | | |
| TOTAL ZONE RETRYS GRIP 040 | 10 | 2 | -1 | 2 | 4 | 2 | 3 | 2 | -1 | 5 | 11 | -8 | 9 | 2 | 10 | -5 | 5 | 9 | 10 | 3 | 1 | 3 | | | | | | | | | |
| TOTAL ZONE RETRYS GRIP 045 | -6 | -2 | 1 | 1 | -2 | -1 | -1 | -9 | 7 | 8 | 6 | 3 | 5 | 8 | 3 | 13 | -1 | 5 | -7 | -3 | -1 | -1 | | | | | | | | | |
| TOTAL ZONE RETRYS GRIP 050 | 2 | 3 | 9 | 2 | 2 | 1 | | -3 | 3 | 6 | | 4 | | -8 | | 8 | -3 | 2 | 6 | -1 | 1 | | | | | | | | | | |
| TOTAL ZONE RETRYS GRIP 055 | -2 | 2 | | 3 | 3 | 1 | 1 | -6 | 3 | 5 | 7 | | 3 | 5 | 11 | 4 | -7 | 7 | -3 | -1 | | | | | | | | | | | |
| TOTAL ZONE RETRYS GRIP 060 | | -3 | 3 | 4 | 3 | 5 | -1 | 4 | 1 | 11 | 3 | -2 | | 1 | -3 | 3 | 1 | 2 | | | | | | | | | | | | | |
| TOTAL ZONE RETRYS GRIP 065 | 1 | | 1 | | -4 | -2 | | -3 | 6 | 1 | -2 | 4 | -11 | 1 | 1 | 7 | -2 | -1 | | | | | | | | | | | | | |
| TOTAL ZONE RETRYS GRIP 070 | -1 | 2 | -1 | 3 | 2 | -5 | 1 | 7 | -3 | 6 | 6 | -1 | 2 | | 4 | 1 | -3 | | | | | | | | | | | | | | |
| TOTAL ZONE RETRYS GRIP 080 | -4 | 3 | 2 | 5 | 1 | | 11 | 7 | -1 | 7 | -7 | -5 | -3 | -1 | -1 | 1 | | | | | | | | | | | | | | | |
| TOTAL ZONE RETRYS GRIP 090 | -2 | 2 | 4 | 2 | 1 | 3 | 2 | -6 | 4 | 3 | 1 | 4 | 1 | -2 | | | | | | | | | | | | | | | | | |
| TOTAL ZONE RETRYS GRIP 110 | 11 | 7 | -1 | -1 | | -3 | -1 | 2 | | | | | | | | | | | | | | | | | | | | | | | |
| TOTAL ZONE RETRYS GRIP 150 | | | | | | | | | | | | | | | | | | | | | | | | | | | | | | | |
| TOTAL ZONE RETRYS GRIP 224 | | | | | | | | | | | | | | | | | | | | | | | | | | | | | | | |
| TOTAL ZONE RETRYS GRIP 344 | | | | | | | | | | | | | | | | | | | | | | | | | | | | | | | |
| TOTAL ZONE RETRYS GRIP 404 | | | | | | | | | | | | | | | | | | | | | | | | | | | | | | | |
| TOTAL ZONE RETRYS GRIP 464 | | | | | | | | | | | | | | | | | | | | | | | | | | | | | | | |
| TOTAL ZONE RETRYS GRIP 480 | | | | | | | | | | | | | | | | | | | | | | | | | | | | | | | |

FIG. 14

CARD HANDLING DEVICES AND ASSOCIATED METHODS

CROSS-REFERENCE TO RELATED APPLICATIONS

This application is a continuation of U.S. patent application Ser. No. 15/360,359, filed Nov. 23, 2016, now U.S. Pat. No. 10,486,055, issued Nov. 26, 2019, which is a continuation of U.S. patent application Ser. No. 14/491,822, filed Sep. 19, 2014, now U.S. Pat. No. 9,504,905, issued Nov. 29, 2016, the disclosure of each of which is hereby incorporated herein in its entirety by this reference.

TECHNICAL FIELD

The present disclosure relates to playing card handling devices that may be used in a casino environment, and particularly playing card handling devices that individually move cards in a stack from one area of the playing card handling device to another area of the playing card handling device.

BACKGROUND

Known card feeding systems in a card handling device may include a support surface with pick-off roller(s) that are located within the support surface to remove one card at a time from the bottom of a vertically-oriented stack of cards. In this orientation, each card face is in a substantially horizontal plane with the face of a card contacting a back of an adjacent card. Such a gravity fed system moves individual cards from one stack into another stack of the card handling device to perform a shuffling operation. Cards may be inserted from the un-shuffled stack into the shuffled stack at a location that is determined by a random number generator (RNG), with the cards in the shuffled stack being gripped by a card gripper to create a gap at the desired location to insert the next card.

Early in the shuffling operation, there may only be a few cards on the elevator platform that holds the shuffled stack of cards. With only a few cards on the elevator platform, there may be some additional airspace (e.g., "fluff") between cards. As more cards are added to the stack, the amount of fluff with those cards may decrease as the weight of the cards above them increases. For example, the first five cards on the stack may have a first thickness when they are the only cards on the elevator platform, but those same first five cards may have a second thickness smaller than the first thickness after more cards are added to the stack. As a result, the grip point for the card gripper to grip the cards for insertion may change over time as cards are added to the stack during a shuffling operation.

Conventional card handling devices have experienced difficulty in dealing with these different thicknesses within the stack. Conventional card handling devices simply determined a grip point based on the number of steps per card multiplied by the number of cards to be left on the platform. Such a method did not account for variations in the height of cards as the number of cards in the stack increased, and the cards on the bottom of the stack became more compressed. As a result, cards may be gripped at an incorrect location, causing cards to be inserted at the incorrect location during a shuffling operation. Thus, the output order of cards of the shuffled deck did not precisely match the virtual order prescribed by the RNG. While some amount of incorrect placement of cards may pass regulations for a "random" shuffle, at some point the shuffled set of cards may not pass the regulatory standard for randomness. The inventors have appreciated improvements to such card handling devices that may better account for these situations so that the shuffled deck may more closely follow the expected order generated by the RNG, and any bias in the shuffled deck may be reduced compared with conventional shuffling devices and methods.

BRIEF SUMMARY

In an embodiment, a playing card handling device comprises an input platform configured to receive an un-shuffled set of cards, an elevator platform configured to receive one or more cards from the input platform to form a shuffled set of cards, a card gripper positioned above the elevator platform, and configured to grip cards from the shuffled set of cards, and a processor. The processor is operably coupled to the input platform, the elevator platform, and the card gripper. The processor is configured to control the elevator platform to have a grip position for the card gripper to grip the shuffled set of cards, wherein the grip position is adjusted based, at least in part, on a correction value associated with a particular card insertion.

In another embodiment, a card handling device comprises a card input area and a card output area configured to transform un-shuffled set of cards into a shuffled set of cards, a card gripper configured to grip cards from the shuffled set of cards, an elevator platform that provides a base for the shuffled set of cards during a shuffling operation, and a processor. The processor is operably coupled with the card gripper and the elevator platform. The processor is configured to generate a virtual shuffled set of cards according to a random number generator, control the card gripper and elevator platform to a defined grip position and create a gap for insertion of a next card during the shuffling operation, and adjust the grip position according to a plurality of different corrective values that are different depending on a number of cards to be gripped and a number of cards on the elevator platform.

In another embodiment, a method of handling cards comprises determining a grip position of an elevator platform of a card handling device based, at least in part, on a desired insertion location within a stack of shuffled cards as adjusted based on a corrective value that is different for a plurality of different insertion locations, moving the elevator platform to the grip position, gripping at least a portion of the stack of shuffled cards if the elevator platform is at the grip position, moving the elevator platform away from the grip position to create a gap, and inserting a card into the gap.

BRIEF DESCRIPTION OF THE DRAWINGS

FIG. 5 is a table showing platform position data corresponding to calibration of the card handling device.

FIG. 12 is a correction table according to an embodiment of the present disclosure.

FIG. 13 is a zone hit counter table according to an embodiment of the present disclosure.

FIG. 14 is a re-try counter table according to an embodiment of the present disclosure.

DETAILED DESCRIPTION

Figure 1:
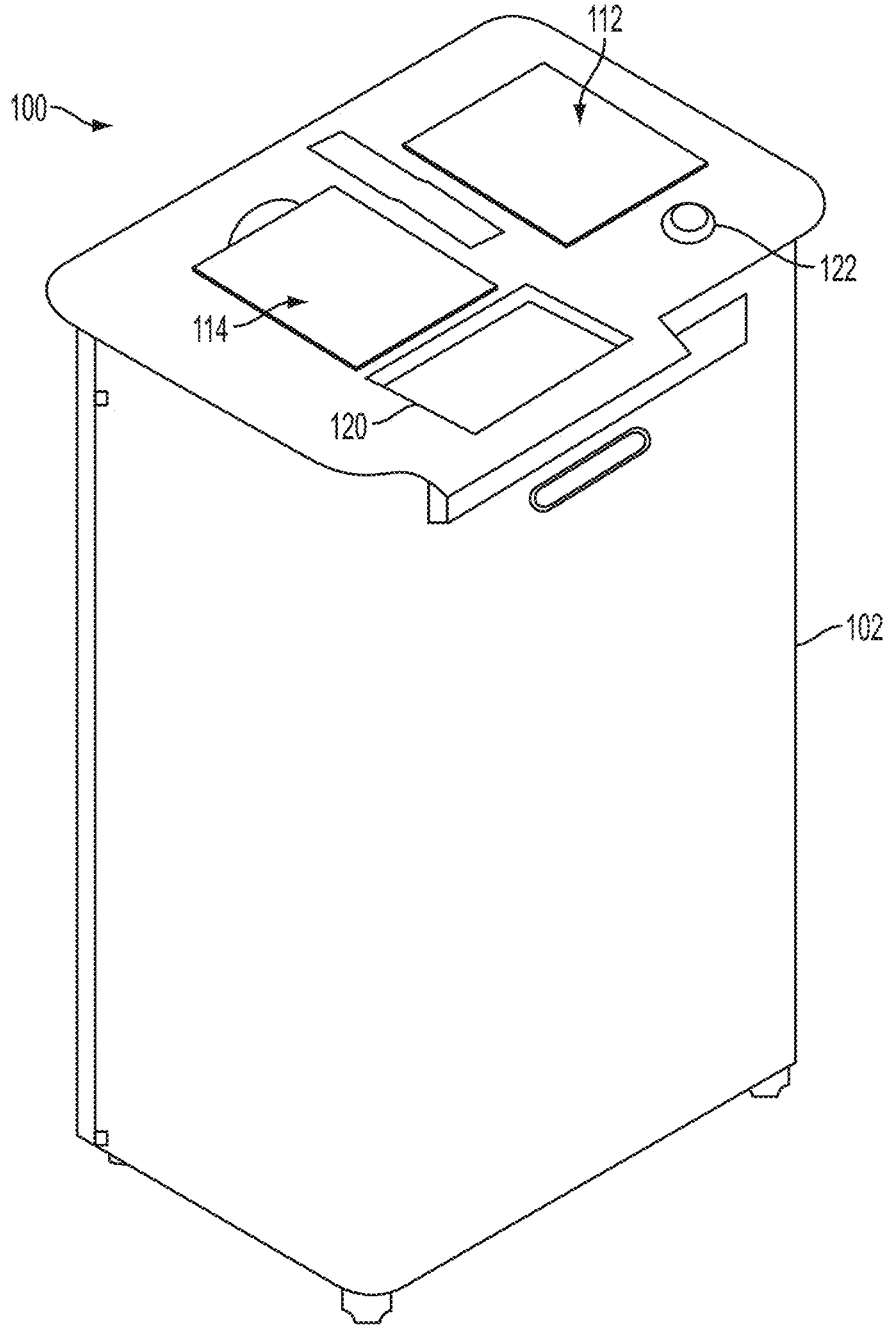
FIG. 1 is a card handling device according to an embodiment of the present disclosure.

In the following description, reference is made to the accompanying drawings in which is shown, by way of illustration, specific embodiments of the present disclosure. Other embodiments may be utilized and changes may be made without departing from the scope of the disclosure. The following detailed description is not to be taken in a limiting sense, and the scope of the present invention is defined only by the appended claims.

Furthermore, specific implementations shown and described are only examples and should not be construed as the only way to implement or partition the present disclosure into functional elements unless specified otherwise herein. It will be readily apparent to one of ordinary skill in the art that the various embodiments of the present disclosure may be practiced by numerous other partitioning solutions.

In the following description, elements, circuits, and functions may be shown in block diagram form in order not to obscure the present disclosure in unnecessary detail. Additionally, block definitions and partitioning of logic between various blocks is exemplary of a specific implementation. It will be readily apparent to one of ordinary skill in the art that the present disclosure may be practiced by numerous other partitioning solutions. Those of ordinary skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present disclosure may be implemented on any number of data signals including a single data signal.

The various illustrative logical blocks, modules, and circuits described in connection with the embodiments disclosed herein may be implemented or performed with a general-purpose processor, a special-purpose processor, a Digital Signal Processor (DSP), an Application-Specific Integrated Circuit (ASIC), a Field-Programmable Gate Array (FPGA) or other programmable logic device, a controller, discrete gate or transistor logic, discrete hardware components, or any combination thereof designed to perform the functions described herein. All of which may be termed "control logic."

A general-purpose processor may be a microprocessor, but in the alternative, the general-purpose processor may be any processor, controller, microcontroller, or state machine suitable for carrying out processes of the present disclosure. A processor may also be implemented as a combination of computing devices, such as a combination of a DSP and a microprocessor, a plurality of microprocessors, one or more microprocessors in conjunction with a DSP core, or any other such configuration.

A general-purpose processor may be part of a general-purpose computer, which should be considered a special-purpose computer when configured to execute instructions (e.g., software code) for carrying out embodiments of the present disclosure. Moreover, when configured according to embodiments of the present disclosure, such a special-purpose computer improves the function of a general-purpose computer because, absent the present disclosure, the general-purpose computer would not be able to carry out the processes of the present disclosure. The present disclosure also provides meaningful limitations in one or more particular technical environments that go beyond an abstract idea. For example, embodiments of the present disclosure provide improvements in the technical field of card handling devices and, more particularly, to apparatuses and related methods for improving the accuracy of shuffling operations by controlling the movement of the elevator platform to a position that corrects for changing characteristics in the stack of cards being shuffled.

Also, it is noted that the embodiments may be described in terms of a process that may be depicted as a flowchart, a flow diagram, a structure diagram, or a block diagram. Although a process may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code on computer readable media. Computer-readable media includes both computer storage media and communication media, including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed or that the first element must precede the second element in some manner. In addition, unless stated otherwise, a set of elements may comprise one or more elements.

As used herein, the term "un-shuffled set of cards" refers to the cards that are on the input platform before a shuffle operation (i.e., when inserted into the card handling device) as well as the cards that may still remain on the input platform during a shuffle operation (i.e., when the shuffle is not yet completed). The un-shuffled set of cards may include any number of cards whether part of a full deck or not. In addition, the un-shuffled set of cards may include one or more decks of cards. Finally, the un-shuffled set of cards may not be required to be in any particular order prior to being shuffled. The un-shuffled set of cards may be in a predetermined order prior to being shuffled (e.g., a newly opened deck), or may be in some other order (e.g., a used deck that is being re-shuffled). In other words, the set of cards to be shuffled and as characterized herein as an "un-shuffled" set may be ordered, randomized, or partially randomized. At times, cards within the un-shuffled set of cards may be referred to as some variation of the term "card" that may or may not describe the cards status within the set.

As used herein, the term "shuffled set of cards" refers to the cards on the elevator platform after a shuffle operation to randomize the set (i.e., when all cards have been moved from the input platform to the elevator platform), as well as cards that have been moved to the elevator platform during a shuffle operation that is not yet completed. For example, after 10 card inserts of a shuffling operation of a full deck (52 cards), 10 cards may be in the shuffled set of cards on the elevator platform and 42 cards may remain in the un-shuffled set of cards. At times, cards within the shuffled set of cards may be referred to as gripped cards, platform cards, or some other variation of the term "card" that may or may not describe the cards status within the set.

Figure 2:
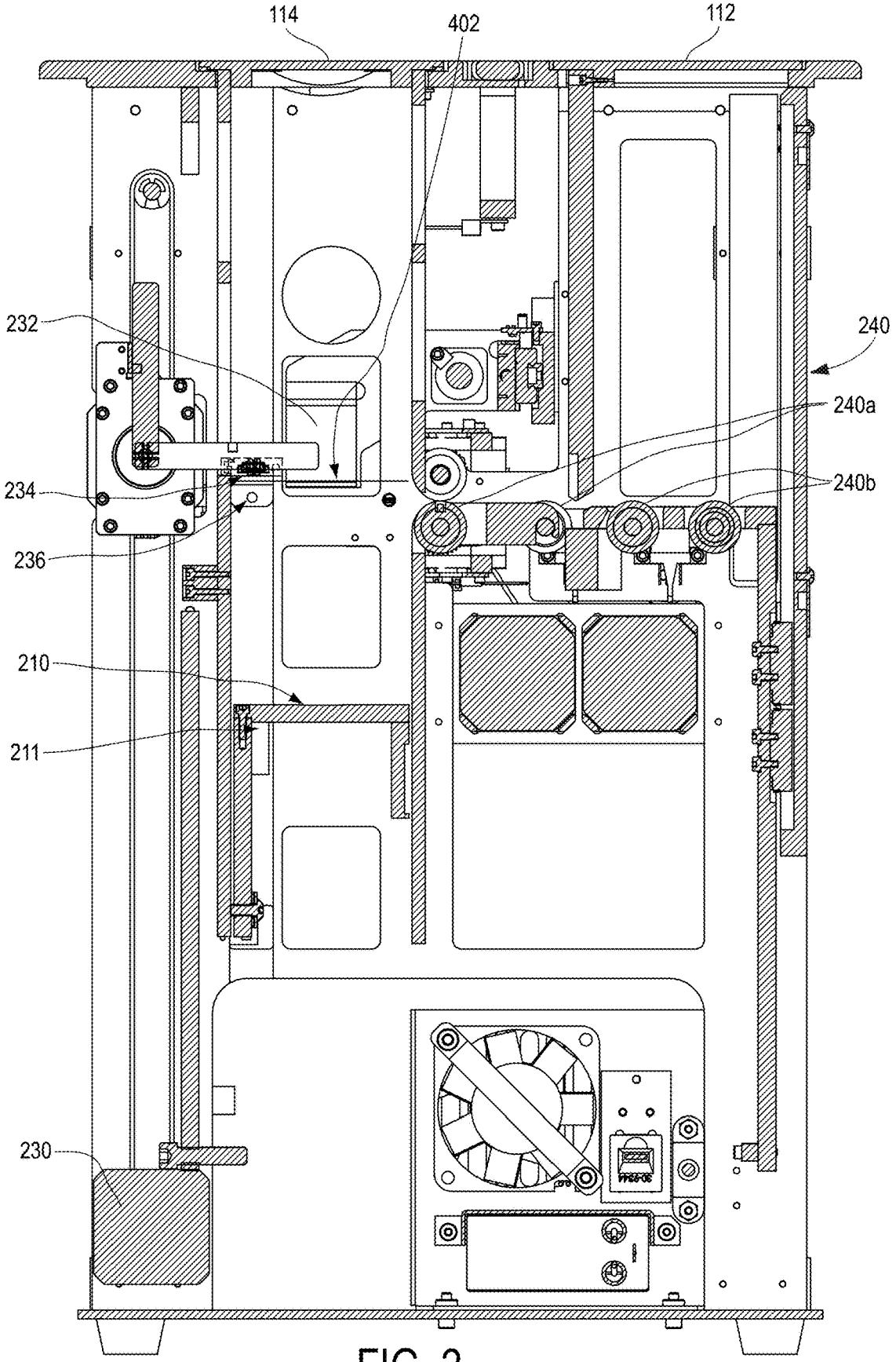
FIG. 2 is a simplified side cutaway view of the card handling device of FIG. 1.
Figure 3:
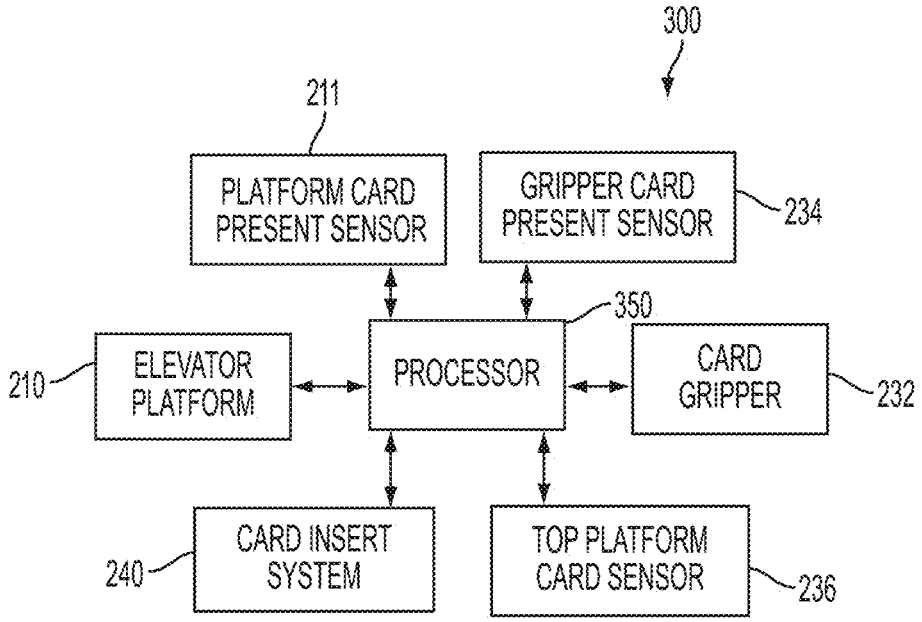
FIG. 3 is a simplified schematic block diagram of a shuffling control system of the card handling device of FIG. 1 according to an embodiment of the present disclosure.

Embodiments of the present disclosure include card handling devices and related methods. It is contemplated that there are various configurations of card handling devices according to an embodiment of the present disclosure. FIGS. 1 through 3, described below, are non-limiting examples of such card handling devices that may employ devices and methods of the present disclosure. Of course, other configurations of card handling devices are also contemplated.

FIG. 1 is a card handling device 100 according to an embodiment of the present disclosure. The structure of the device is more fully described in U.S. Patent Publication No. 2014/0138907 to Rynda et al., filed Nov. 11, 2013, which is assigned to the assignee, the disclosure of which is incorporated in its entirety herein by this reference.

The card handling device 100 includes a housing 102 for the mechanical and electrical components of the card handling device 100. The housing 102 may also include a card insertion area 112 and a card output area 114. The card handling device 100 may further include user interface devices, such as a display panel 120 and a button 122. The display panel 120 may be configured to provide information (e.g., graphically, alphanumerically, etc.) to a user (e.g., dealer, casino personnel, service technician, etc.). Such information might include the number of cards present in the card handling device 100, the status of any shuffling or dealing operations, hand information, security information, confirmation information, on/off status, self-check status, among other information that may be desirable regarding the play and/or the operation of the card handling device 100. The button 122 (or touchscreen controls on the display panel 120) may include on/off buttons, special function buttons (e.g., raise elevator to the card delivery position, operate jam sequence, reshuffle demand, security check, card count demand, calibrate, etc.), and the like. The display panel 120 may also be configured to received inputs (e.g., as a touchscreen display) to perform operations on the card handling device 100.

In operation, sets of cards (e.g., up to 8 decks) may be inserted into the card insertion area 112 to be shuffled. The card handing device 100 may include an input platform (not shown) that moves up (e.g., opens) for manual insertion of the un-shuffled set of cards to be shuffled. The input platform may move down (e.g., closes) to place the un-shuffled set of cards in a fixed position within the card insertion area 112. The card handling device 100 may also include an output platform (not shown) that may also move up (e.g., open) for manual removal of the shuffled set of cards from the card output area 114.

During shuffling, cards may be moved (e.g., fed) from the card insertion area 112 to a temporary card collection area within the housing 102 to form a shuffled set of cards. The input platform may not move during the shuffle. Within the temporary card collection area, however, an elevator platform 210 (FIG. 2) within the card output area 114 is controlled to move up or down during the shuffle to a desired position. If the elevator platform 210 is in the desired position, a card gripper 232 (FIG. 2) is controlled to grip a desired number of cards after which the elevator platform 210 is lowered to create a gap for a new card to be inserted between the gripped cards and the platform cards remaining on the elevator platform 210. The desired location to grip the cards to create the gap may be determined by a random number generator (RNG). The bottom card on the input platform may be moved from the stack of cards in the card insertion area 112 to the elevator platform 210 in the temporary card collection area after the gap is made. As a result, the inserted card from the un-shuffled set of cards is placed in the stack, the stack positioned on top of the platform cards on the elevator platform 210. The next card on the bottom of the un-shuffled set of cards on the input platform may be inserted at the next desired location in a similar manner according to the RNG. The remaining cards from the un-shuffled set of cards may be similarly moved from the input platform to a space in the stack of cards on the elevator platform 210 until all the cards have been moved. As a result, controlling the operation of the card handling device 100 may transform the un-shuffled set of cards into the shuffled set of cards. Once shuffled, the elevator platform 210 may be moved to the top of the card handling device 100, and the shuffled set of cards may be removed to be dealt.

In addition to shuffling, the card handling device 100 may be configured to perform additional operations, such as counting cards, verifying cards, etc. The card handling device 100 may include mechanized card shoes, card set checking devices, automatic card shufflers, card sorting devices, card decommissioning devices, and the like. In some embodiments, multiple sets of cards may be processed simultaneously. For example, one set of cards may be shuffled while another set of cards may be dealt from a shoe.

FIG. 2 is a simplified side cutaway view of the card handling device 100 of FIG. 1. As shown in FIG. 2, the card handling device 100 may further include an elevator platform motor 230, a card gripper 232, a gripper card present sensor 234, a top platform card sensor 236, and a card insert system 240. The card insert system 240 may include one or more pick-off rollers 240A and one or more sets of speed-up rollers 240B. The elevator platform 210 may include a platform card present sensor 211 (e.g., optical sensor, pressure sensor, magnetic detector, sonar detector, etc.) that is configured to detect the presence of cards or other objects on the elevator platform 210. For purposes of this disclosure, only some of the components of the card handling device 100 are discussed in this section for simplicity. The card handling device 100, however, may include additional components that are not explicitly discussed in this section, such as those described in U.S. Pat. No. 8,579,289 to Rynda et al., issued Nov. 12, 2013; U.S. Pat. No. 8,556,263 to Grauzer et al., issued Oct. 15, 2013; U.S. Patent Publication No. 2013/0161905 to Grauzer et al., published Jun. 27, 2013; and U.S. Patent Publication No. 2014/0175724 to Swanson, published Jun. 26, 2014, the disclosure of each of which documents is incorporated in its entirety herein by this reference.

The elevator platform motor 230 may be configured to drive the elevator platform 210 that in turn carries the shuffled set of cards (not shown) to the card gripper 232 to be separated, creating a gap within the shuffled set of cards between the gripped cards and the cards remaining on the elevator platform 210. The card insert system 240 may insert a card from the card insertion area 112 into the gap created within the cards by the card gripper 232 and the elevator platform 210. The elevator platform motor 230 may be configured to be highly controlled in its degree of movement. For example, the elevator platform motor 230 may include a microstepped motor. Microstepping the elevator platform motor 230 may control the precise amount of movement for driving the position of the elevator platform 210. With microstepping, the movement of the elevator platform 210 may be controlled to less than a card thickness per microstep. The movements per microstep may be less than 0.9 a card's thickness, less than 0.8 a card's thickness, less than 0.5 a card's thickness, less than 0.4 a card's thickness, less than ⅓ a card's thickness, less than 0.25 a card's thickness, less than 0.20 a card's thickness, and even less than 0.05 a card's thickness. In an embodiment where a microstep may be 0.04 a card's thickness, each card is approximately 25 microsteps thick. As a result, the smaller the microstep, the more accurate the positioning of the elevator platform 210 may be provided, which may contribute to the cards being more likely to be inserted at the desired location. The positions of the motor may simply be referred to herein as "steps," which may include microsteps and other steps of various levels of accuracy.

The elevator platform motor 230 may also be configured to assist the card handling device 100 in internal checks for moving the elevator platform 210 to the correct position. For example, the elevator platform motor 230 may include an encoder (not shown) that is configured to determine the position of the elevator platform 210. The encoder may be configured to evaluate the position of the elevator platform 210 through analysis and evaluation of information regarding, for example, the number of pulses per revolution of the spindle on the elevator platform motor 230, which may be greater than 100 pulses per revolution, greater than 250 pulses per revolution, greater than 360 pulses per revolution, greater than 500 pulses per revolution or greater than 750 pulses per revolution, and, in preferred embodiments, greater than 1000 pulses per revolution, greater than 1200 pulses per revolution, and equal to or greater than 1440 pulses per revolution. In operation, a processor 350 (FIG. 3) may control the movement of the elevator platform motor 230, the encoder counts the amount of movement driven by the elevator platform motor 230, and then determines the actual position of the elevator platform 210 or a space (e.g., four cards higher) relative to the elevator platform 210.

The gripper card present sensor 234 may be positioned within the card gripper 232, and may be configured to detect when at least one card on the elevator platform 210 has been raised to a position that can be gripped by the card gripper 232. The gripper card present sensor 234 may alternatively be placed on other surfaces adjacent the card gripper 232, such as other adjacent walls or elements. The gripper card present sensor 234 may include an optical proximity sensor (e.g., reflective sensor) or other sensor element.

The top platform card sensor 236 may be positioned within the temporary card collection area below the card gripper 232, and may be configured to detect when the top card on the elevator platform 210 is aligned with the top platform card sensor 236. Alignment of the top card on the elevator platform 210 with the top platform card sensor 236 may be detected during calibration to generate reference data, as well as during a shuffle after the cards have been gripped to determine how many cards remain on the elevator platform 210 and verify the accuracy of the grip before inserting a card. As a result, the height of the stack of cards on the elevator platform 210 may be determined. The top platform card sensor 236 may include an optical proximity sensor (e.g., reflective sensor) or other sensor element. For example, the top platform card sensor 236 may be a diffuse sensor configured to detect objects in the range of 5 mm to 40 mm from the top platform card sensor 236. The top platform card sensor 236 may be configured to detect the edge of an object travelling perpendicular to the top platform card sensor's 236 triangular beam pattern. The top platform card sensor 236 may be coupled to the elevator platform motor 230 as a limit switch so that as the elevator platform 210 raises, the elevator platform motor 230 stops when the top platform card is detected by the top platform card sensor 236. The processor 350 may then record the position of the elevator platform 210.

Although FIGS. 1 and 2, show substantially vertical card stacks with gravity teed systems, it is contemplated that some embodiments may also include cards that are in horizontally aligned stacks, as well as in stacks that are positioned at an angle with respect to the vertical or horizontal directions. For example, some embodiments may provide a stack of cards that is rotated 5 degrees to 10 degrees with respect to the vertical direction, which may aid in maintaining alignment of the stack.

FIG. 3 is a simplified schematic block diagram of a shuffling control system 300 of the card handling device 100 of FIG. 1 according to an embodiment of the present disclosure. The shuffling control system 300 may include a processor 350 that is operably coupled to the elevator platform 210, the card gripper 232, the platform card present sensor 211, the gripper card present sensor 234, the top platform card sensor 236, and the card insert system 240.

The processor 350 is configured to control and direct the operation of the card handling device 100 and its various components. In particular, the processor 350 may control the operation of the elevator platform 210 (e.g., what position should the elevator platform 210 be moved to), the card gripper 232 (e.g., when should the card gripper 232 grip and/or release the card), and the card insert system 240 (e.g., when to insert a card to the elevator platform 210). It is recognized that the processor 350 may be configured to send commands to motors that control the movement of the elevator platform 210, the card gripper 232, the card insert system 240, and other components. The processor 350 may also be configured to send commands to other components (e.g., card identification units) that may also contribute to the operation of the card handling device 100. These additional components are not shown so that FIG. 3 may be simplified in showing the components that are discussed in detail herein.

The processor 350 may determine where the card from the un-shuffled set of cards should be inserted within the set of shuffled cards on the elevator platform 210. The insertion location may be determined by a random number generator (RNG). The processor 350 may include the RNG; however, in some embodiments, the RNG may be a separate component within the card handling device 100, or may be part of a component external to the card handling device 100.

Using the generated random numbers, the processor 350 may be configured to generate a virtual shuffled set of cards that may be used for physically shuffling a set of cards. The virtual shuffled set of cards may be generated in the form of a random number insertion table. For example, Table 1 shows an example of a random number insertion table (also referred to as an "insertion table"), which may be stored in memory for use by the processor 350. The insertion table may be generated for a set of 52 cards (e.g., one deck of cards). The insertion table may be different sizes for sets of cards having more or fewer cards.

TABLE 1

| OPN | RPN |
|---|---|
| 1 | 13 |
| 2 | 6 |
| 3 | 39 |
| 4 | 51 |
| 5 | 2 |
| 6 | 12 |
| 7 | 44 |
| 8 | 40 |
| 9 | 3 |
| 10 | 17 |
| 11 | 25 |
| 12 | 1 |
| 13 | 49 |
| 14 | 10 |
| 15 | 21 |
| 16 | 29 |
| 17 | 33 |
| 18 | 11 |
| 19 | 52 |
| 20 | 5 |
| 21 | 18 |
| 22 | 28 |
| 23 | 34 |
| 24 | 9 |
| 25 | 48 |
| 26 | 16 |
| 27 | 14 |
| 28 | 31 |
| 29 | 50 |
| 30 | 7 |
| 31 | 46 |
| 32 | 23 |
| 33 | 41 |
| 34 | 19 |
| 35 | 35 |
| 36 | 26 |
| 37 | 42 |
| 38 | 8 |
| 39 | 43 |
| 40 | 4 |
| 41 | 20 |
| 42 | 47 |
| 43 | 37 |
| 44 | 30 |
| 45 | 24 |
| 46 | 38 |
| 47 | 15 |
| 48 | 36 |
| 49 | 45 |
| 50 | 32 |
| 51 | 27 |
| 52 | 22 |

The insertion table may include the set of numbers used to determine the "insertion position" each time a card is moved from the input platform to the elevator platform 210. For example, each card in the un-shuffled set of cards may be provided with a specific number that is associated with that particular card, herein referred to as the original position number (OPN). Each OPN may be assigned according to positions within the un-shuffled set of cards. If cards are fed from the bottom of the stack onto the elevator platform 210, the cards may be assigned an OPN from the bottom to the top. For example, the bottommost card of the stack may be CARD 1, the next card being CARD 2, the next card being CARD 3, etc. If cards are fed from the top of the stack, the cards may be assigned an OPN from top to bottom. The RNG may assign a random position number (RPN) to each card within the un-shuffled set of cards. The RPN may be the randomly determined final position for each card in the final shuffled set of cards. Thus, the insertion table may represent the expected shuffle results after the card handling device 100 transforms the un-shuffled set of cards into a shuffled set of cards.

In operation, the processor 350 may identify each card by its OPN, and, using the RPN, control the elevator platform 210 to move into the desired position where the card may be properly inserted into the shuffled set of cards being formed as a stack on the elevator platform 210. For example, the first card from the input platform may be moved to the elevator platform 210. To determine where to put the second card, the processor 350 may consult the insert table, and either place the second card above or below the first card on the elevator platform 210. To place the second card below the first card, the processor 350 may control the card gripper 232 to grip the first card, control the elevator platform 210 to move lower, and control the card insert system 240 to insert the second card into the gap between the first card (gripped by the card gripper 232) and the elevator platform 210. Subsequent cards may be similarly inserted by the processor 350 determining how many cards to grip in order to leave the correct number of cards on the elevator platform 210. The number of cards to be gripped and temporarily suspended may be referred to as the "grip number." The elevator platform 210 may be moved to the "grip position" for the grip number of cards on the elevator platform 210 to be gripped. The elevator platform 210 may be lowered to the "insertion position," creating a gap to insert the next card. The shuffle continues until all of the cards have been moved from the input platform to the elevator platform 210.

If the grippers grip the cards perfectly, the shuffled set of cards should exactly match the virtual shuffle generated by the RNG. However, gripping errors may occur due to natural variations in the cards and the mechanical aspects of gripping the cards. Natural variations in the thickness of the stack of cards may result from fluff, bending, warping, static electricity, or other variations that may be caused by wear or use of the cards. The card variations may contribute to variations in the height (i.e., thickness) of the stack of cards on the elevator platform 210. Variations in the height of cards may also depend on the number of cards in the stack. For example, the height of the bottommost five cards may be different when there are more cards above them than when there are fewer cards above them. Thus, inserting a card in the sixth insertion location may require moving the elevator platform 210 to a different grip position when there are ten cards compared to when there are forty cards. The processor 350 may adjust for these differences according to a correction table, which maintains correction values indicating how many steps to adjust (e.g., up or down) the elevator platform 210 from its grip position associated with a particular insertion characteristic. The correction table may also be updated during shuffling to dynamically adjust its calibration over time. The correction table will be discussed further below.

For the following FIGS. 4A through 19, reference is made to the components of the card handling device 100 as shown in FIG. 1 through 3. Thus, the reference numerals of the different components may remain in the description even though a figure is discussed that does not show that particular component of the card handling device 100.

Figure 4A:
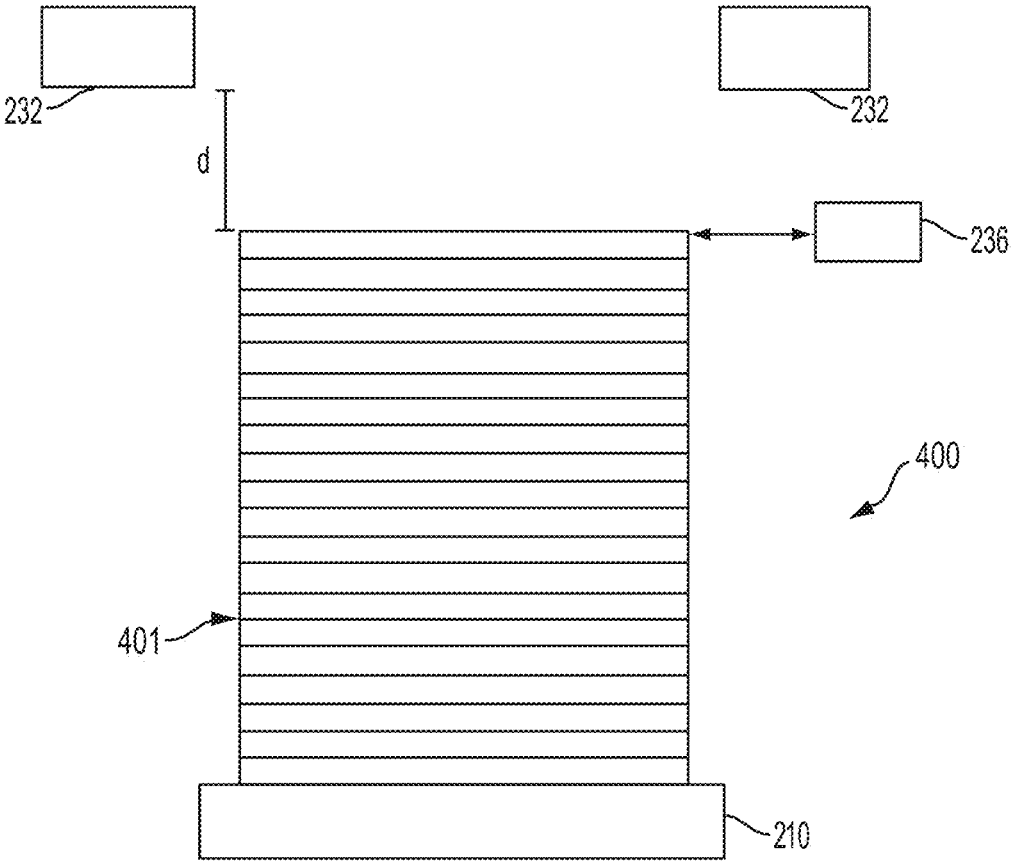
FIG. 4A is a stack of cards that may be present within the temporary card collection area on the elevator platform.

FIG. 4A is a stack of cards 400 that may be present within the temporary card collection area on the elevator platform 210. The stack of cards 400 in FIG. 4A may represent cards during a shuffling operation when the cards are not gripped.

During a shuffling operation, a card may inserted within the stack of cards 400 at a desired insertion location determined by the RNG, as discussed above. The processor 350 may determine an insertion location 401 according the desired number of cards that should remain on the elevator platform 210 in order to insert the card in the desired location. Thus, the elevator platform 210 may be moved so that the insertion location 401 aligns with the card gripper 232. In the example shown in FIG. 4A, the insertion location 401 for the inserted card is between the $6^{th}$ and $7^{th}$ card presently in the stack of cards 400. The elevator platform 210 may be moved to the position that the insertion location 401 (e.g., the $6^{th}$ card in this example) is approximately aligned with the card gripper 232, which can be approximated by the position that the insertion location 401 (e.g., $6^{th}$ card) is approximately aligned with the top platform card sensor 236 plus an additional distance (d) between the top platform card sensor 236 and the card gripper 232.

The position of the elevator platform 210 for the cards to be gripped may be referred to as the grip position. As discussed further below, the grip position may be adjusted according to a correction table, which may store correction values for the grip position to account for variations in card locations depending on the size of the current stack of cards on the elevator platform 210.

The stack of cards 400 may also represent cards during an initial calibration operation in which the cards may be inserted for purposes of card measurement and generating data from which the correction table may be generated, rather than performing shuffling (although during calibration some shuffling may be performed, if desired). In addition, card measurement data may be obtained during a shuffling operation, such as by recording such information prior to gripping cards for the next card insertion.

In some embodiments, the height of the stack of cards 400 on the elevator platform 210 may be determined for each various number of cards that may be placed on the elevator platform 210. Determining the height of the stack of cards may include recording the position of the elevator platform 210 each time a card is added to the top of the stack of cards 400 so that the top card is detected by the top platform card sensor 236. For example, the processor 350 may detect a transition in the signal from the top platform card sensor 236, which transition indicates the platform cards being detected vs. not detected (i.e., the top card position is identified). The position of the elevator platform 210 at which that transition occurs may be recorded. The position of the elevator platform 210 may be measured in steps (e.g., microsteps) relative to a home position located at the bottom of the card handling device 100. For example, the position of the elevator platform 210 with 1 card may be 11234, with 5 cards may be 11127, and so on.

Positions of the elevator platform 210 may be recorded for each number of cards (e.g., 1, 2, 3, 4 . . . ). For example, one card may be inserted onto the elevator platform 210 and the elevator platform 210 may be lowered below the top platform card sensor 236, and then raised until the transition point is detected by the top platform card sensor 236. The position of the elevator platform 210 may be recorded. A second card may be inserted onto the elevator platform 210 and the elevator platform 210 may be lowered below the top platform card sensor 236 and then raised until the next transition point is detected. The position of the elevator platform 210 may be recorded. A third card, a fourth card, a fifth card, etc., may be inserted with the position of the elevator platform 210 recorded at each corresponding transition point. In some embodiments, rather than lowering the elevator platform 210 below the top platform card sensor 236 and then raising the elevator platform 210 until the transition point is detected, the elevator platform 210 may be lowered to detect the transition point with downward movement of the elevator platform 210.

Positions of the elevator platform 210 may be recorded for a selected sub-set of cards (e.g., 1, 5, 10, 25 . . . ). For example, one card may be inserted onto the elevator platform 210 and the platform may be lowered until the transition point is detected. The position of the elevator platform 210 may be recorded. Four additional cards may be inserted onto the elevator platform 210 (for a total of five cards) and the platform may be lowered until the next transition point is detected. The position of the elevator platform 210 may be recorded. Five additional cards may be inserted onto the elevator platform 210 (for a total of ten cards) and the platform may be lowered until the next transition point is detected. The position of the elevator platform 210 may be recorded. Additional groups of cards may be inserted with the position of the elevator platform recorded at each corresponding transition point. This method may be particularly advantageous for large sets of cards (e.g., multiple decks) where the time savings of only recording data for a sub-set may outweigh the advantages of recording data for each stack height. Further details for this recording, including taking multiple readings to obtain an average position for each stack height, will be discussed with reference to FIG. 5.

Figure 4B:
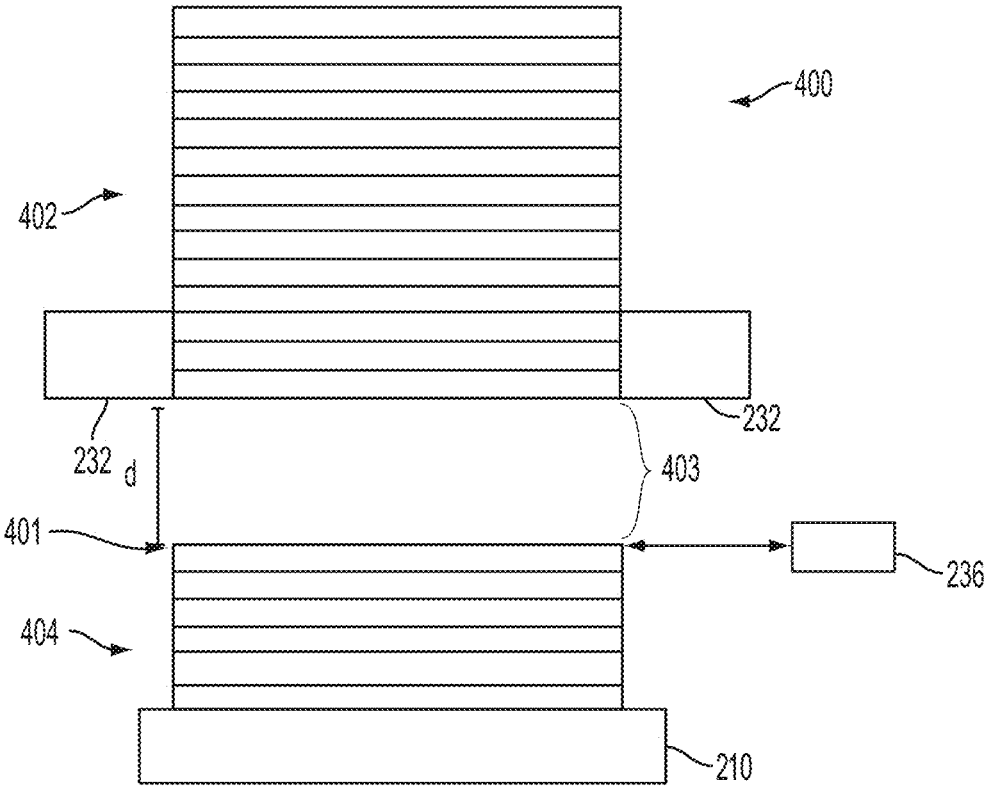
FIG. 4B shows cards being gripped by the card gripper in order to create a gap for the next card to be inserted.

FIG. 4B shows cards 402 being gripped by the card gripper 232 in order to create a gap 403 for the next card to be inserted. The elevator platform 210 is raised to the grip position to align the insertion location 401 with the card gripper 232 (with any correction table adjustment), the card gripper 232 may then grip the edges of the cards, and the elevator platform 210 may be lowered to create the gap 403. Thus, two sub-stacks may be formed: the gripped cards 402 are suspended by the card gripper 232, and the platform cards 404 remain on the elevator platform 210.

After the cards are gripped, the processor 350 may also determine the actual number of cards remaining on the elevator platform 210 before the next card is inserted. If the elevator platform 210 is not correctly positioned, the number of cards gripped and the number of cards on the elevator platform 210 may not be correct (in terms of what is expected), which would result in the next card not being inserted at the intended insertion location 401. The actual number of cards remaining on the elevator platform 210 may be determined by lowering the elevator platform 210 to align the top card of the remaining cards to find the transition point using the top platform card sensor 236. The actual position may be compared with the reference position, which is the expected platform position for that number of cards. The height of the platform cards 404 remaining on the elevator platform 210 after a grip should be approximately the same as the height of the platform cards 404 when that same number of cards is first put on the elevator platform 210 during the shuffling operation (or during calibration measurements). Thus, discrepancies between the actual position and the reference position may indicate that the actual number of cards remaining on the elevator platform 210 and the expected number of cards remaining do not match.

If there are substantial discrepancies between the actual number and the expected number of cards remaining on the elevator platform 210, the cards may be re-gripped and/or the correction table may be updated depending on the nature of the discrepancy. As a result, the actual shuffled set of cards may more closely match the expected shuffled deck generated by the RNG system by improving the accuracy of inserting the cards during the shuffle. The next card may then be inserted into the gap 403 onto the top of the platform cards 404. The elevator platform 210 may be raised and the gripped cards 402 may then be released to join cards on the elevator platform 210. The process may continue until all cards from the un-shuffled set are moved to the elevator platform 210.

The goal of the card handling device 100 may be to output a shuffled set of cards that matches the "virtual shuffled set" of the insertion table generated by the RNG system; however, it is recognized that some errors may still occur. While some amount of incorrect placement of cards may pass regulations for a "random" shuffle, at some point the shuffled set of cards may not pass the regulatory standard for randomness. Embodiments of the present disclosure may reduce (or eliminate) the occurrence of shuffles failing the regulatory standard for randomness in comparison with a conventional device.

Figure 4C:
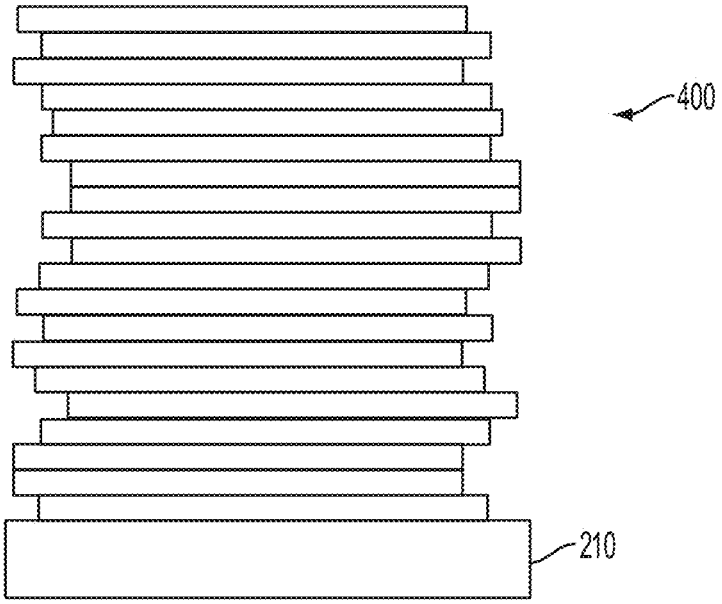
FIG. 4C is a stack of cards that are not lined up evenly during a shuffling operation.

As shown in FIG. 4C, there may be some situations in which the shuffled set of a deck of cards may not be lined up evenly vertically during a shuffling operation, which may cause the card gripper 232 to stop short of how far the card gripper 232 was commanded to close when gripping the cards. As a result, the card gripper 232 may not close completely on the cards 400, and some of the cards may fall back onto the elevator platform 210 that should have been gripped. To address this problem, the card gripper 232 may be controlled to be moved in and out horizontally repeatedly, which may push the cards together in a more even way before the card gripper 232 is commanded to grip the cards for an actual card insertion.

In addition, there may be some situations, in which a small number of un-gripped cards may "stick" to the bottom of the gripped cards when the elevator platform 210 is lowered. This may be caused by surface tension, static tension, or other interactions between the cards that cause them to stick together. To address this problem, the card gripper 232 may be closed slightly as the elevator platform 210 is lowered. The slight closing motion may occur some time delay after the cards are gripped and the elevator platform 210 is lowered. The small closing motion of the card gripper 232 may cause the bottom card(s) of the gripped cards to bow in a downward direction as the elevator platform 210 is lowering. The bowing of the bottom gripped card may cause the surface area of any un-gripped cards adjacent to the bottom card to be reduced, causing the un-gripped card(s) to fall from the gripped cards 402 back onto the elevator platform 210.

FIG. 5 is a table 500 showing platform position data corresponding to calibration of the card handling device 100. The platform position data includes a first set of data 502, a second set of data 504, and a third set of data 506. This table 500 may also be referred to as the "deck height table" because the data in the table 500 may indicate the height of the cards on the elevator platform 210. It should be noted, however, that the data shown in FIG. 5 corresponds to a position of the elevator platform 210 when the top card is detected by the top platform card sensor 236 rather than a value that is a direct measurement of the height of the cards. The height of the cards may be derived from the positional data; however, the calculations, comparisons, etc., are described herein as being performed in terms of positions of the elevator platform 210 in relation to the top platform card sensor 236 or other sensor. Of course, additional processing steps may generate actual height measurements, which may be also used as the values stored and processed to perform the various operations described herein.

The first set of data 502 is generated from a number of readings indicating the position of the elevator platform 210 when the top card is detected by the top platform card sensor 236 for various different numbers of cards. For example, the first row of the first set of data 502 shows that the position of the elevator platform 210 was at positions 11234, 11244, 11244, 11246, 11252, etc., for the various readings when there was only 1 card on the elevator platform 210. The second row of the first set of data 502 shows that the position of the elevator platform 210 was at positions 11127, 11134, 11135, 11139, 11140, etc., for the various readings when there were 5 cards on the elevator platform 210. Other readings may be taken for other numbers of cards (e.g., 10, 25, 45, 55, 65, 80, 90, 100) on the elevator platform 210 to obtain the corresponding positions of the elevator platform 210. Readings may be taken for any number of cards; however, this example shows that ten card numbers (e.g., 1, 5, 10, 25, 45, 55, 65, 80, 90, 100, the numbers indicating a position in the stack starting at the bottom) were selected for obtaining readings. In addition, the number of readings per card number for this example is also ten; however, other numbers of readings (e.g., fifteen) per card number are contemplated.

Because of the variations in the deck height measurements, it may be unreliable to use a single measurement from the first data set 502 directly when positioning the elevator platform 210 during a shuffling operation. Therefore, the second data set 504 may be generated representing an average position for each card number of the first data set 502. In some embodiments, all readings for each card number may be averaged, while in other embodiments a subset of the readings for each card number may be averaged. As an example of one subset that may be averaged, the readings for each card number may be sorted (e.g., from high to low) and the middle three readings may be averaged. For example, the average position for one card on the elevator platform 210 shown is 11253.33, the average position for five cards on the elevator platform 210 is shown to be 11140.67, the average position for ten cards on the elevator platform 210 is shown to be 11017, and so on.

These average positions may only change a few steps in either direction over a large number of shuffles, which may result in more stable data during shuffling. This is shown by the third data set 506 that is generated representing the difference between each reading (from the first data set 502) and the average position (from the second data set 504) of each corresponding card number on the elevator platform 210 across all readings. Using the readings and average for 1 card on the elevator platform 210 as an example, the first reading (11234) is different from the average value (11253.33) by (−19.33) steps. The rest of the third data set 506 is generated in a similar manner.

The data shown in FIG. 5 may be generated during an initial calibration operation in which the cards may be inserted for purposes of card measurement and generating data from which the correction table may be generated. For example, measurements may be obtained by simply moving cards from the input platform to the top of the elevator platform 210 without performing shuffling. In some embodiments, the data of FIG. 5 may be obtained during a shuffling operation. For example, measurements may be obtained after a card insertion, but before the next set of cards are gripped. A reading may be obtained before the next card is inserted. The positions from FIG. 5 may be referred to as "one-dimensional" data because the data may be obtained by taking readings that relate only to one dimension (e.g., taking readings while increasing cards on the elevator platform 210 without having to determine a number of cards to grip). Thus, the one-dimensional method may be based only on the height of cards on the elevator platform.

Figure 6:
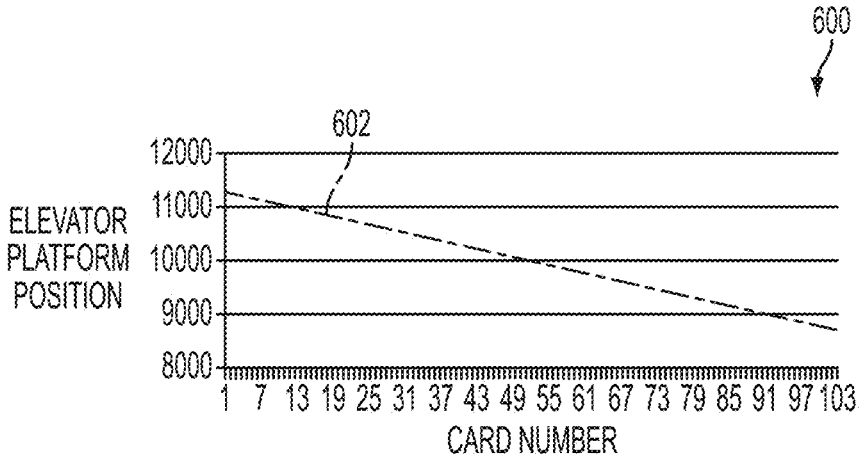
FIG. 6 is a plot showing the elevator position of the platform when the top card on the elevator platform is at the top platform card sensor.

FIG. 6 is a plot 600 showing the position of the elevator platform 210 when the top card on the elevator platform 210 is at the top platform card sensor 236. The X-axis is the number of cards on the elevator platform 210, and the Y-axis is the corresponding position of the elevator platform to align with the top platform card sensor 236. The line 602 may be generated from the average position data (second data set 504) of FIG. 5. As the data from FIG. 5 did not include values for every possible number of cards, the line 602 may be fit (e.g., interpolated) from the data to provide estimates for the other numbers of cards. As a result, positions may be determined for each number of cards without needing to perform readings for over all numbers of cards. As an example, the plot shows that when there are 49 cards on the elevator platform, the position of the elevator platform is at about 10000. As 49 cards was not one of the numbers where readings were taken in FIG. 5, this position is an estimate based on the data that was taken. Of course, some embodiments may include readings and averages for all possible card numbers that could be on the elevator platform during shuffling.

Figure 7:
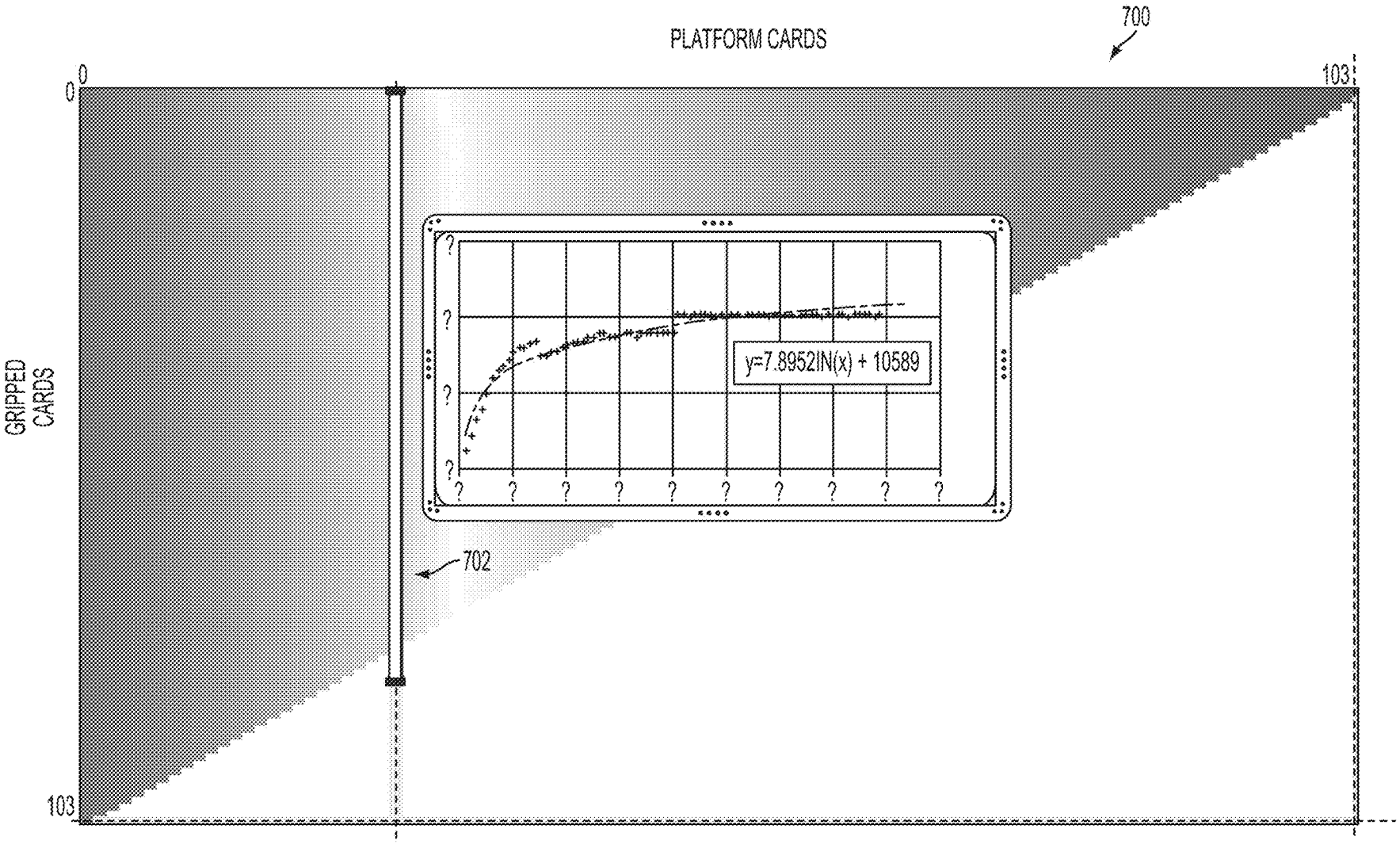
FIG. 7 is a plot showing the positions of the elevator platform for various grip points when there are cards remaining on the elevator platform.

FIG. 7 is a plot 700 showing the positions of the elevator platform 210 for various grip points when there are cards remaining on the elevator platform 210. The vertical axis represents the number of cards gripped by the card gripper 232. The horizontal axis represents the cards remaining on the elevator platform 210. The particular plot 700 shown is for two decks of cards (e.g., 104 cards) and the possible combinations of gripped cards vs. platform cards at the various stages of a shuffling operation. The positions from FIG. 7 are referred to as "two-dimensional" because the date may be obtained from two kinds of data, namely grip position and the number of cards gripped. Thus, the two-dimensional method is based on a combination of a number of cards to be gripped and a number of cards on the elevator platform 210. The number of cards on the elevator platform 210 used in the two-dimensional method may be the total number of cards on the elevator platform 210 and/or the number of cards to remain after the grip.

For example, a rectangle 702 shows one data set for all possible combinations of the number gripped cards for 25 cards remaining on the elevator platform 210. In order to leave 25 cards on the elevator platform 210, 1 card needs to be gripped if there are 26 cards on the elevator platform 210 prior to the grip. If there are 103 cards on the elevator platform 210, 78 cards need to be gripped in order to leave 25 cards on the elevator platform 210. In each of these situations, a card insert would occur on top of the $25^{th}$ card. As discussed above, the thickness of a number of cards may vary depending on how many cards are above them. For example, 25 cards may have a first thickness with 1 card on top, and the same 25 cards may have a second thickness (thinner than the first thickness) with 78 cards on top. As a result, the position of the elevator platform 210 needed to obtain the proper grip point to leave 25 cards on the elevator platform 210 may depend on the total number of cards in the stack. As an example, the position of the elevator platform 210 for gripping 1 card and leaving 25 cards may be 10585, while the position of the elevator platform 210 for gripping 78 cards and leaving 25 cards may be 10621. This is a difference of 36 steps for leaving the same 25 cards on the elevator platform 210 depending on how many cards are on top of the stack.

The data collected for the card handling device 100 may indicate that the position of the elevator platform 210 for gripping cards may be formed (e.g., fit) into an equation. For example, the data from FIG. 7 may be formed into the following equation in some embodiments:

$$y=7.8\ \ln(x)+C \quad (1),$$

where "y" is the grip position, "x" is the number of cards gripped, and C is an offset constant that may depend on where the 0 position is defined.

Figure 8:
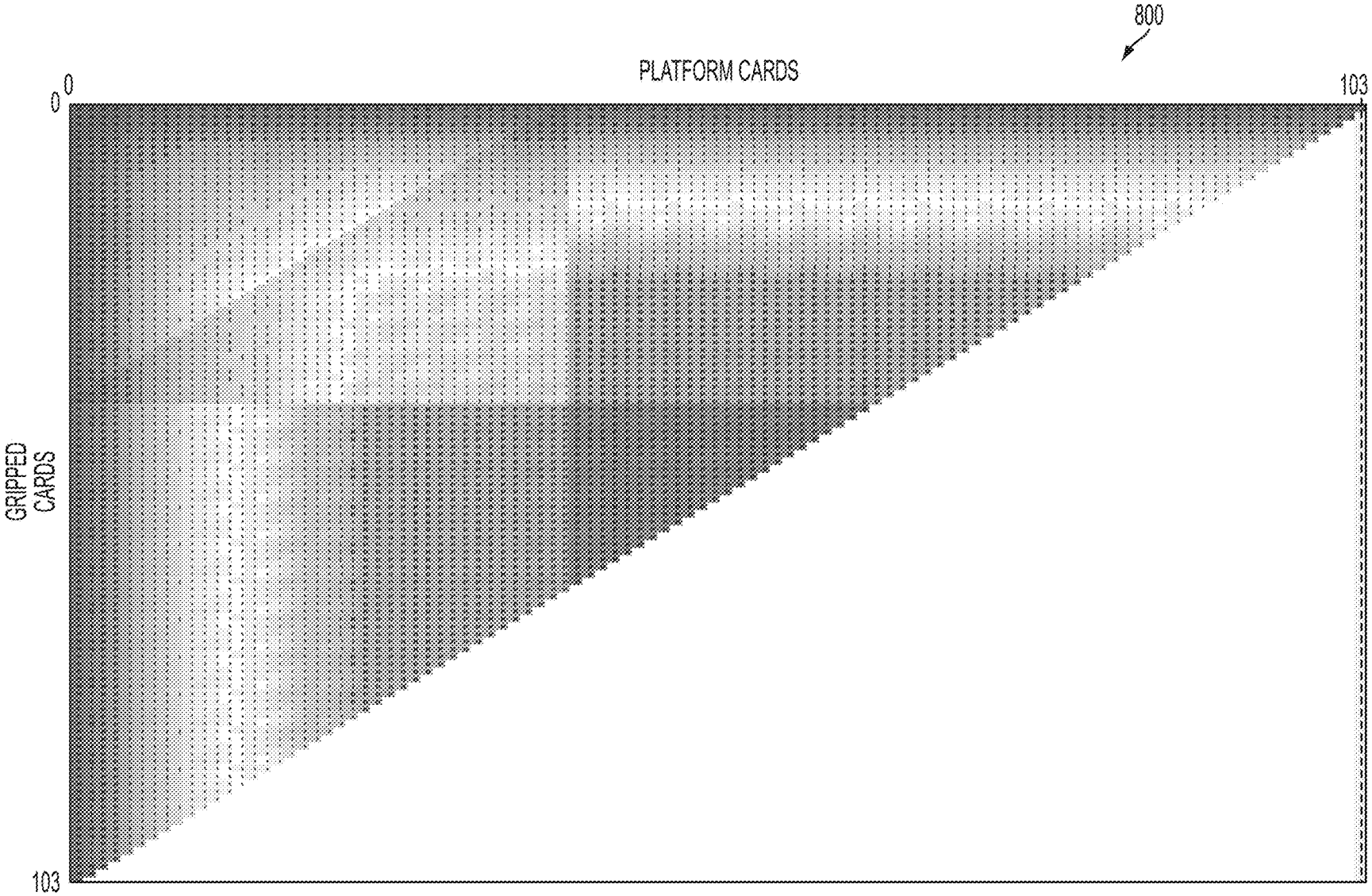
FIG. 8 is a plot showing the difference between the "one-dimensional" and "two-dimensional" methods of determining the position of the elevator platform for gripping cards at various points during a shuffle.

FIG. 8 is a plot 800 showing the difference between the "one-dimensional" and "two-dimensional" methods of determining the position of the elevator platform 210 for gripping cards at various points during a shuffle. In particular, the platform positions determined by the one-dimensional method (FIG. 6) may be subtracted from the platform positions determined by the two-dimensional method (FIG. 7) to generate the difference data of FIG. 8. The darker shaded areas indicate greater differences than the lighter shaded area. The darker shaded areas near the hypotenuse of the triangle were generally positive values (i.e., the two-dimensional method generated a higher platform position than the one-dimensional method), while the darker shaded areas near the outside edges of the triangle were generally negative values (i.e., the two-dimensional method generated a lower platform position than the one-dimensional method).

Embodiments of the present disclosure may use the one-dimensional method, the two-dimensional method, or a combination thereof to generate the grip position and/or the reference position.

Reference Position

The reference position may be determined based on the one-dimensional method (e.g., the method generating the data of FIG. 6), the two-dimensional method (e.g., the method generating the data of FIG. 7), or a combination thereof. The reference position may refer to the position of the elevator platform 210 for the desired insertion location to be aligned with the top platform card sensor 236.

As an example of a reference position generated from a combination of the one-dimensional method and the two-dimensional method, the reference position may be generated according to the following equation:

$$\text{Reference Position (RP): } RP=P1+\tfrac{1}{2}(P2-P1)+C \text{ steps} \quad (2).$$

The first term (P1) is the position using the one-dimensional method, ½(P2−P1) one-half of the value generated by subtracting the position using the one-dimensional method (P1) from the position using the two dimension method (P2), and the third term (C) is a bias constant value to compensate for a bias (if needed). Equation (2) may simplify to:

$$RP=\frac{1}{2}(P1+P2)+C \text{ steps} \quad (3).$$

Thus, the reference position may be an average between the values of the one-dimensional method and the two-dimensional method. This average may be more accurate than using either the one-dimensional method or the two-dimensional method individually, because the individual error profiles for the one-dimensional method and the two-dimensional may produce biases that are generally opposite of each other. P1 and P2 may be positions of the elevator platform 210 for the insert position to be aligned with the top platform card sensor 236. As discussed above, the positions of the elevator platform 210 may be converted into actual height values (in microsteps) that may be compared used to compare with a measured height of platform cards.

Grip Position

The processor 350 may determine the grip position of the elevator platform 210 for inserting a card at a desired location. The grip position may be determined by the insertion location plus the distance (d) between the top platform card sensor 236 and the card gripper 232 with any adjustments according to the correction value (if any) in the corresponding zone cell of the correction table. The distance (d) may be measured and stored during a setup procedure for the card handling device 100. The insertion position may be determined by the "two-dimensional" method to determine where the cards should be gripped in order to grip the correct number of cards and leave the correct number of cards on the elevator platform 210.

Comparing Reference Position and Measured Position

After the cards are gripped during a shuffle operation, the remaining platform cards may be measured to determine the accuracy of the grip. The measured position may be the position of the elevator platform 210 at which the top platform card sensor 236 detects the top card of the remaining platform cards. The measured position may be compared with the reference position prior to each card insertion. Reference height and actual height values may also be used for this comparison. If there is a difference, the correction table may be adjusted as will be discussed below. As a result, the next time the grip position is determined, an updated correction value from the correction table may be used, which may result in the error being reduced.

Figure 9:
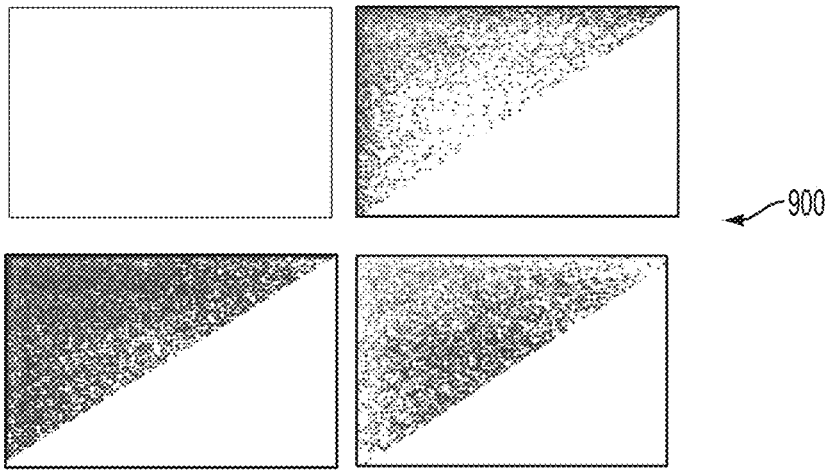
FIGS. 9 through 11 are plots showing different error reports for card inserts over one thousand shuffles using different methods for generating the reference position.
Figure 10:
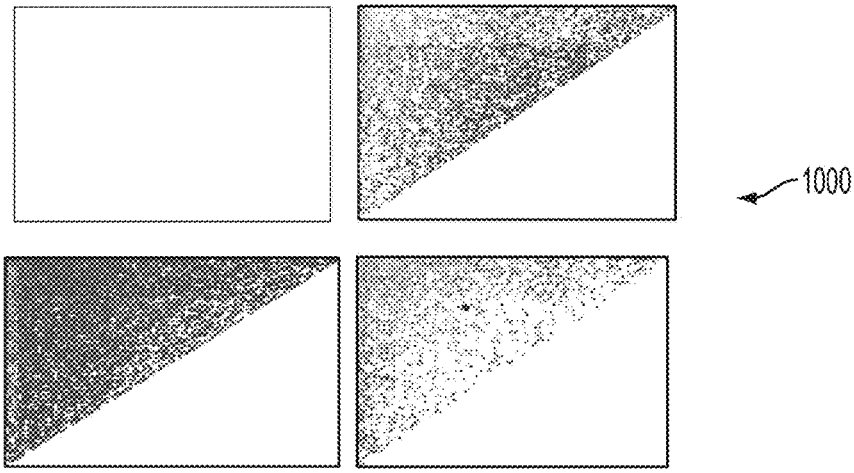
Figure 11:
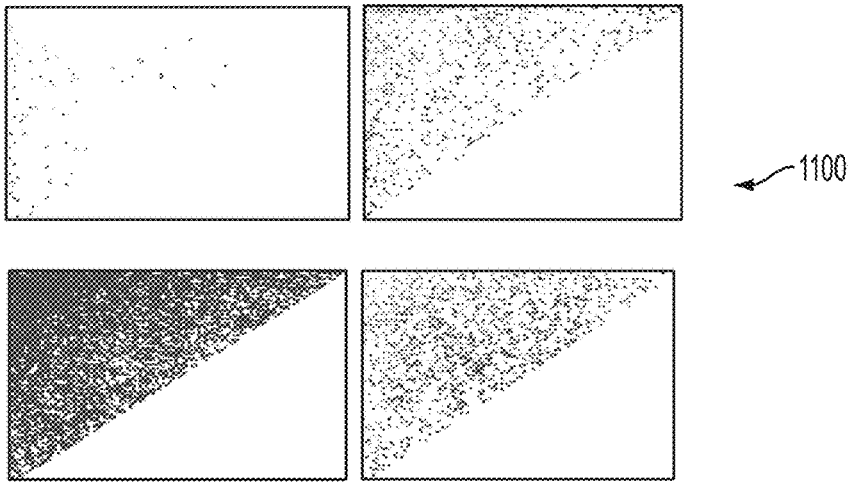

FIGS. 9, 10, and 11 are plots 900, 1000, 1100 showing different error reports for card inserts over one thousand shuffles using different methods for generating the reference position. Each plot 900, 1000, 1100 has four quadrants that each have a triangle of different fullness. The horizontal axis of each quadrant is the number of cards on the elevator platform 210, and the vertical axis of each quadrant is the number of cards gripped by the card gripper 232. The cells are numbered from 0 to 103. The cell in the upper left hand corner of the triangle is 0 cards on the elevator platform and 0 cards gripped. Each cell within each triangle has a value between 0 and 1, which value is the average of all of the inserts for all of the shuffles for a given insertion location. If the shade of the cell is white, the average is near zero. If the shade of the cell is dark, the average is closer to 1.

The triangle in the lower left quadrant of each plot 900, 1000, 1100 shows the number of correct inserts for the respective set of one thousand shuffles. The triangle in the upper right quadrant of each plot 900, 1000, 1100 shows the number of inserts that were incorrect by minus 1 card for the respective set of one thousand shuffles. The triangle in the lower right quadrant of each plot 900, 1000, 1100 shows the number of inserts that were incorrect by plus 1 card for the respective set of one thousand shuffles. The triangle in the upper left quadrant of each plot 900, 1000, 1100 shows the number of inserts that were incorrect by more than 1 card for the respective set of one thousand shuffles.

Referring specifically to FIG. 9, the data in the plot 900 results from a system using the one-dimensional method only (FIG. 6) for determining the reference position. That is, the reference position used to generate this data is the position of the elevator platform 210 only considering the cards as they are placed on the elevator platform 210 prior to a grip.

Referring specifically to FIG. 10, the data in the plot 1000 results from a system using the two-dimensional method only (FIG. 7) for determining the reference position. That is, the reference position used to generate this data is the position of the elevator platform 210 considering the cards being gripped and the cards remaining on the elevator platform 210.

Referring specifically to FIG. 11, the data in the plot 1100 results from a system using a balanced approach (both the one-dimensional method and two-dimensional method) for determining the reference position. That is, the reference position used to generate this data is the position of the elevator platform 210 considering equation (2) from the above example.

When comparing the three error plots 900, 1000, 1100, the error pattern in the bottom right triangle may be more dense using the one-dimensional method (FIG. 9) while the top right triangle may be more dense using the two-dimensional method (FIG. 10). Thus, the one-dimensional method may tend to under grip the cards on the elevator platform 210, while the two-dimensional method may tend to over grip the cards on the elevator platform 210. The one-dimensional method and the two-dimensional method both had biases that caused errors; however, the biases were different.

The differences shown in FIG. 9 and FIG. 10 may be corrected by using the "balanced" method as shown in FIG. 11. Thus, even though some errors may still occur, the number of errors may be reduced in number, as well as being more balanced by not strongly favoring under-gripping or over-gripping. Thus, the opposing biases of the two approaches may be evened out across the various card inserts over the course of a shuffle. As a result, the grip positions may be more accurate, which may result in a shuffled set of cards that more closely follows the insertion table generated by the RNG.

FIG. 12 is a correction table 1200 according to an embodiment of the present disclosure. The correction table 1200 may be used by the processor 350 to leave the correct number of cards on the elevator platform 210. The correction values stored in each cell of the correction table 1200 may instruct the card handling device 100 the number of steps to add to or subtract from the corresponding insertion points when determining a grip position for the elevator platform 210.

The correction table 1200 may be two-dimensional by having the correction value depend on both the number of platform cards to remain on the elevator platform 210 and the number of gripped cards to be gripped by the card gripper 232. In operation, when inserting a card into the shuffled set of cards during a shuffling operation, the number of cards on the elevator platform 210 may be known. It may be determined how many cards should be gripped and how many cards should remain on the elevator platform 210 in order to insert the card at the desired location determined by the insert table. A grip position may be determined, which may then be adjusted based on the correction table 1200. As an example, there may be 16 cards on the elevator platform 210. The card handling device 100 may determine that 8 cards should be gripped and 8 cards should remain on the elevator platform 210 for a card insertion, and a grip position for the elevator platform 210 may be determined. The grip position may then be adjusted based on the corresponding correction value in the correction table 1200 for that particular combination. In this example, the correction value is −20 steps for leaving 8 cards on the elevator platform 210 and gripping 8 cards.

In some embodiments, a correction value may be determined for each possible combination of gripped cards and platform cards. Such an approach may require a large correction table 1200 that is relatively slow to tune; however, having a correction value for all combinations may improve accuracy. In some embodiments, the correction table 1200 may be divided into zones that treat some groups of cards within a zone to be the same in terms of the amount of correction applied to a grip position within that zone. For example, any number of gripped cards between 22 and 25 will use the same zone cell for the correction table to determine the number of steps to correct when performing a grip. Some zones may include relatively small groups of cards (e.g., 2 or 3), while some zones may include relatively larger groups of cards (e.g., 10 or 20 cards). Zones may be smaller for lower numbers of cards shuffled, and increased in size as the number of cards shuffled increases. By grouping the correction values into zones, the operating speed and tuning speed may increase at the expense of potentially reducing the accuracy.

The correction tables 1200 may be automatically created and dynamically adjusted (e.g., corrected, updated, etc.) for the life of the card handling device 100 to respond to changes in the operation of the card handling device 100 and/or the use of the cards. In operation, the correction table 1200 may be automatically generated by the card handling device 100 with initial values (e.g., 0) placed in each zone cell for initialization. Thus, for the first card insert at a location within a particular zone, the grip position may not be adjusted by the correction table 1200 because the zone cell has a value of zero. The correction table 1200 may be adjusted dynamically to change the correction values if errors still exist. In particular, after the cards have been gripped, the cards remaining on the elevator platform 210 may be compared to a reference value. If the measured position of the platform cards is different than the reference position, the corresponding value in the correction table 1200 may be adjusted according to the difference. The difference may be added to the current value of the zone cell to generate a new value to be used for correction of the next card grip. In some embodiments, a different value other than the difference may be added to the current value of the zone cell. For example, the size of the adjustment may be a set amount depending on how many previous adjustments have been made to a particular zone cell (e.g., as tracked by the zone hit counter table described below).

The correction table 1200 may be continually adjusted as more cards are shuffled. The more times a zone is updated, the finer the adjustments to that zone. In this way, the entire correction table 1200 is tuned. Because the correction table 1200 is continuously updated from measurements recorded during shuffling operations, the correction table 1200 may track variations in the cards as the cards age or other factors (e.g., humidity changes), that can also affect accuracy of a shuffle.

Embodiments of the present disclosure may include additional tables that may also be used to assist in the adjustment of the correction table 1200. These additional tables may be same size as the correction table 1200. A first table may be used to count the number of inserts for each zone cell of the correction table 1200. A second table may be used to monitor re-grips for a given insert.

FIG. 13 is a zone hit counter table 1300 according to an embodiment of the present disclosure. The zone hit counter table 1300 counts the number of card inserts (i.e., "hits") over time for each zone cell of the correction table 1200 (FIG. 12). For example, prior to the first time a card insert is performed for a given zone, the corresponding zone cell in the zone hit counter table 1300 may be zero. Each time a card is inserted into a location within a given zone, the corresponding zone hit counter table 1300 may be incremented. As shown in FIG. 13, the zone cell corresponding to 4 gripped cards and 4 platform cards has a value of 21. That means that there have been 21 instances that a card has been inserted into the location of the set of cards with 4 gripped cards and 4 platform cards for the corresponding card handling device 100. The card inserts may occur over different shuffling operations. For some zones that are larger in size, multiple card inserts may occur within that zone during the same shuffling operation. As a result, the zone hit counter table 1300 counts the number of card inserts for each zone during the lifetime of the shuffler.

The zone hit counter table 1300 may be used to control the number of re-grips that the card handling device 100 may perform before moving on. As the hits in a zone cell increase, the number of allowed re-grips may decrease. In an example, the card handling device 100 may permit 3 re-grips for situations corresponding to a zone cell having a value less than 10, permit 2 re-grips for situations corresponding to a zone cell having a value between 10 and 19, and permit 1 re-grip for situations corresponding to a zone cell having a value greater than 19.

The zone hit counter table 1300 may also be used to control the magnitude of the adjustments to the correction table 1200. As the hits in a zone cell increase, the size of the adjustments to the correction table 1200 may decrease. For example, the card handling device 100 may permit adjusting the correction table 1200 by ±5 steps for situations corresponding to a zone cell of the zone hit counter table 1300 having a value less than 8, permit adjusting the correction table 1200 by ±3 steps for situations corresponding to a zone cell of the zone hit counter table 1300 having a value between 10 and 19, and permit adjusting the correction table 1200 by ±2 step for situations corresponding to a zone cell of the zone hit counter table 1300 having a value greater than 19.

The zone hit counter table 1300 may be automatically created and dynamically incremented for the life of the card handling device 100 as cards are inserted during shuffles. In operation, the zone hit counter table 1300 may be automatically generated by the card handling device 100 with initial values (e.g., 0) placed in each zone cell for initialization. In some embodiments, one or more zone cells of the zone hit counter table 1300 may be reset.

FIG. 14 is a re-try counter table 1400 according to an embodiment of the present disclosure. The re-try counter table 1400 counts the number and direction of re-grips during a shuffling operation. The value in each zone cell will increment or decrement in the same direction when the correction value in the correction table 1200 (FIG. 12) is incorrect. During a shuffling operation, the cards may be re-gripped if the number of cards remaining on the elevator platform 210 does not match what is expected. The value in the corresponding zone cell may be adjusted in the direction of the needed adjustment for the re-grip. For example, prior to the first time a card insert is performed for a given zone, the corresponding zone cell in the re-try counter table 1400 may be zero. Each time a card is inserted into a location within a given zone, the corresponding re-try counter table 1400 may be incremented. The value of the zone cell may be incremented for an under grip situation or decremented for an over grip situation. Over time, zone cells may begin to favor re-grips in a particular direction, which may indicate that the correction table 1200 is not effective in its updating. If a zone cell in the re-try counter table 1400 reaches a maximum value (e.g., max=20), the card handling device 100 may be configured to reset the corresponding zone cells in the zone hit counter table 1300 (FIG. 13), and the correction table 1200 may be reset to zero. As a result, the corresponding zone cell may be re-initialized in the correction table 1200.

The re-try counter table 1400 may be automatically created and dynamically incremented and/or decremented for the life of the card handling device 100 as cards are re-gripped during shuffles. In operation, the re-try counter table 1400 may be automatically generated by the card handling device 100 with initial values (e.g., 0) placed in each zone cell for initialization. In some embodiments, one or more zone cells of the re-try counter table 1400 may be reset.

Embodiments of the present disclosure may include each unique card handling device 100 creating and maintaining its own unique correction table 1200, zone hit counter table 1300, and re-try counter table 1400, grip points, reference points, etc., that are generated and/or adjusted according to the unique characteristics of the individual card handling device 100.

In addition, each card handling device 100 may include different stored settings for different unique decks that may be used by the card handling device 100. In other words, the card handling device may have a correction table, reference points, etc., associated with a first deck, and another correction table, reference points, etc., for a second deck type. As an example, the card handling device 100 may use at least two decks of cards—one deck may be shuffled while the other deck may be dealt from a shoe. These different decks of cards may have different characteristics, which may be depend on the deck type, the amount of use, and handling. For example, even decks of the same type may have different characteristics as they may experience different amounts of use. As a result, one of the decks of cards may become more warped, bent, or otherwise worn than the other deck, which may result in more corrections needed. Thus, each deck may be more accurately shuffled if each deck has its own calibration settings (including data, tables, etc.) associated with it over the use of the deck.

In some embodiments, the user may select which settings and data should be used by the card handling device 100 when shuffling by selecting which deck is going to be shuffled. In some embodiments, the card handling device 100 may automatically identify which calibration settings should be used. For example, the card handling device 100 may read in the positional data of the un-shuffled set of cards for various numbers of cards (e.g., using the "one-dimensional method") and determine which settings stored in the card handling device 100 more closely matches the positional data. If the positional data does not sufficiently match any of the stored settings in the card handling device 100, new settings (e.g., positional data, reference points, tables, etc.) may be generated and initialized. In some embodiments, the card handling device 100 may provide the dealer with the option as to which deck is being used so that the correct calibration settings are used for the selected deck. In some embodiments, the card handling device 100 may know the order that decks are being used and simply load the calibration settings for the next deck that is expected to be shuffled.

Figure 15:
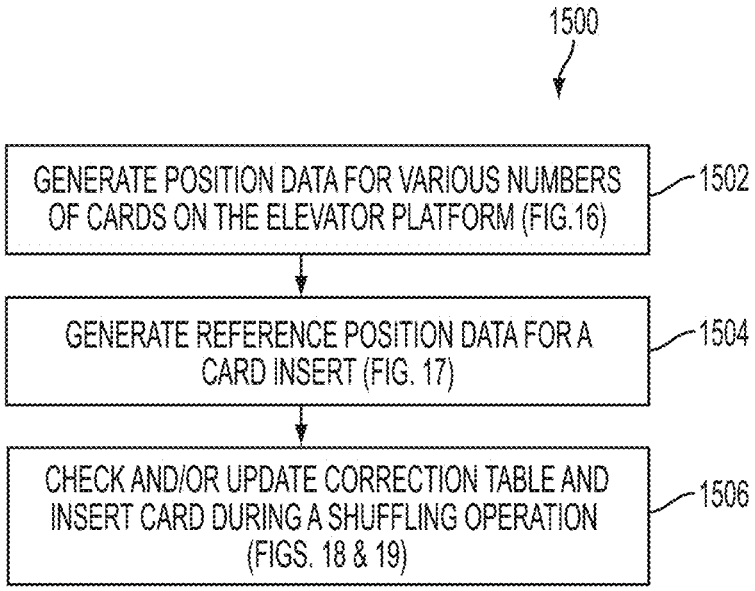
FIGS. 15 through 19 are flowcharts illustrating methods for operating a card handling device according to an embodiment of the present disclosure.

FIG. 15 is a flowchart 1500 illustrating a method for operating a card handling device 100 according to an embodiment of the present disclosure. In particular, the method may calibrate the card handling device 100 to account for the mechanical operation of the card handling device as well as variations in the sets of cards being shuffled. The calibration may include automatically generating the appropriate calibration settings (e.g., various data, tables, etc.) to perform the shuffling, as well as dynamically adjusting the calibration settings during the operation of the card handling device 100. Each of operations 1502, 1504, 1506 will be briefly discussed with reference to FIG. 15; however, further details will be provided in FIGS. 16, 17, 18, and 19.

At operation 1502, position data for various numbers of cards on the elevator platform 210 may be generated and stored. The position data may indicate the height of various numbers of cards that may be present on the elevator platform 210 prior to being gripped. For example, the position data may include the data shown in the card height table of FIG. 5.

At operation 1504, the reference position data for a card insert may be generated. The reference position data may be based on the one-dimensional approach, the two-dimensional approach, or a composite approach of both the one-dimensional approach and the two-dimensional approach. For example, the reference position may be determined according to equation (3) described above.

At operation 1506, the correction table may be checked and/or updated while inserting cards during a shuffling operation. Each time that a grip occurs during a shuffle, the height of the remaining cards may be measured by recording the position of the elevator platform 210 at which the top platform card is detected by the top platform card sensor 236. The measured position may be compared to the reference position to determine whether there is a difference. Depending on the result of this determination, the correction table (and other tables) may be updated and/or a card may be inserted.

Figure 16:
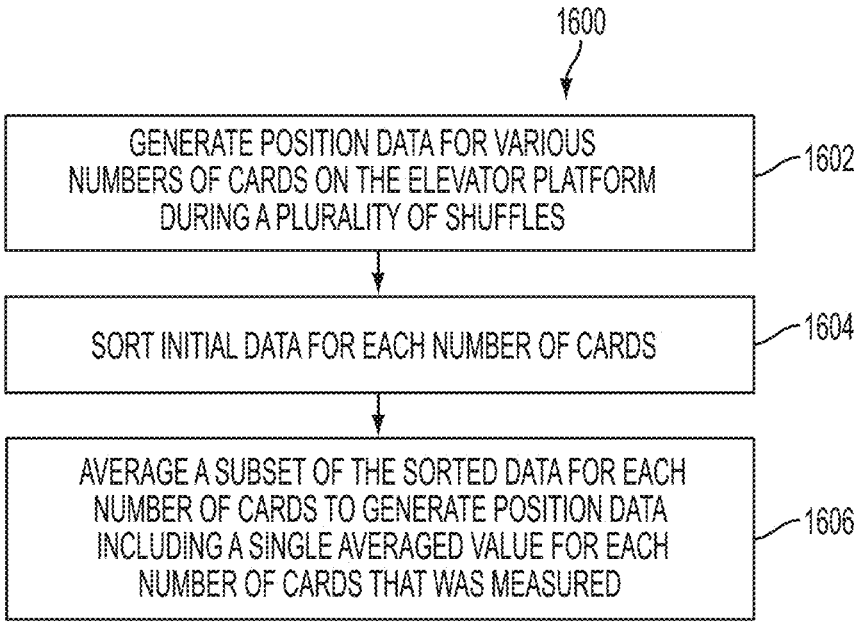

FIG. 16 is a flowchart 1600 illustrating a method for operating a card handling device 100 according to an embodiment of the present disclosure. In particular, the flowchart 1600 may provide additional details to operation 1502 of FIG. 15. The data resulting from operations 1602, 1604, 1606 may be stored in memory, for example, as the deck height table of FIG. 5.

At operation 1602, position data for various numbers of cards on the elevator platform 210 may be generated during a plurality of shuffles. The position data may be determined by recording the position of the elevator platform 210 when the top card on the elevator platform 210 is detected by the top platform card sensor 236. In some embodiments, the position data may be recorded for all possible heights for the platform cards. In some embodiments, the position data may be recorded for some of the heights of the platform cards. The position data may include multiple readings for platform cards of the same height. For example, the card handling device 100 may perform 10 readings for each card height that is sampled. Other numbers of readings (e.g., 15 readings) may be performed for each card height that is sampled.

At operation 1604, the positional data may be sorted for each number of cards. For example, if each card height has 10 readings, the 10 readings may be sorted numerically from high to low, or from low to high.

At operation 1606, an average position may be generated for each card height. In some embodiments, a middle group of the sorted readings (e.g., the middle three sorted readings) may be averaged to generate an average position. In some embodiments, all readings may be averaged to generate an average position. Other methods of averaging are also contemplated, including using the median position, the mode, or some other similar averaging technique. Such averaging may be desirable as an individual reading may be inaccurate and may vary from one reading to the next (e.g., at times by 20 steps or more).

Figure 17:
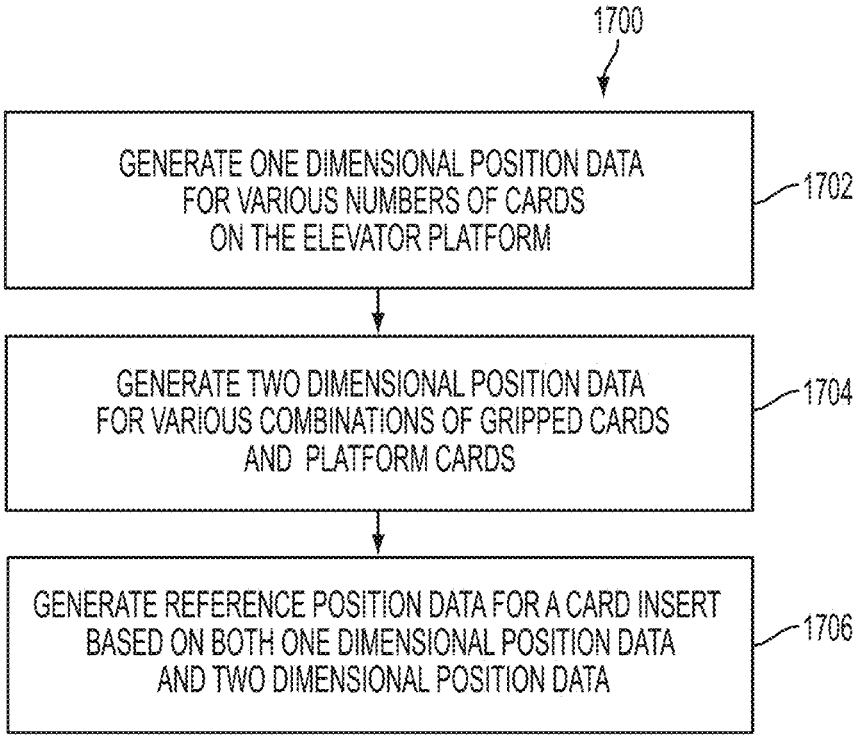

FIG. 17 is a flowchart 1700 illustrating a method for operating a card handling device 100 according to an embodiment of the present disclosure. In particular, the flowchart 1700 may provide additional details to operation 1504 of FIG. 15.

At operation 1702, one-dimensional position data may be generated for various numbers of cards on the elevator platform. This one-dimensional data may be the positional data generated by operation 1502 of FIG. 15 and further described in FIG. 16.

At operation 1704, two-dimensional position data for various combinations of gripped cards and platform cards may be generated. This two-dimensional position data may be generated by taking readings during a shuffle before and after grips to determine the height of gripped cards and platform cards. In some embodiments, the data may be fit into an equation to represent an estimate of the two-dimensional positions for all combinations of gripped cards and platform cards, such as equation (1) described above.

At operation 1706, reference position data may be generated for a card insert based on both the one-dimensional position data and the two-dimensional position data. The reference position data may include position values that are an average of the data using the one-dimensional method and the two-dimensional method, as described in equation (3) above. As a result, the opposite biases of each method may be smoothed out to reduce the number and magnitude of insertion errors over the course of the shuffle.

Figure 18:
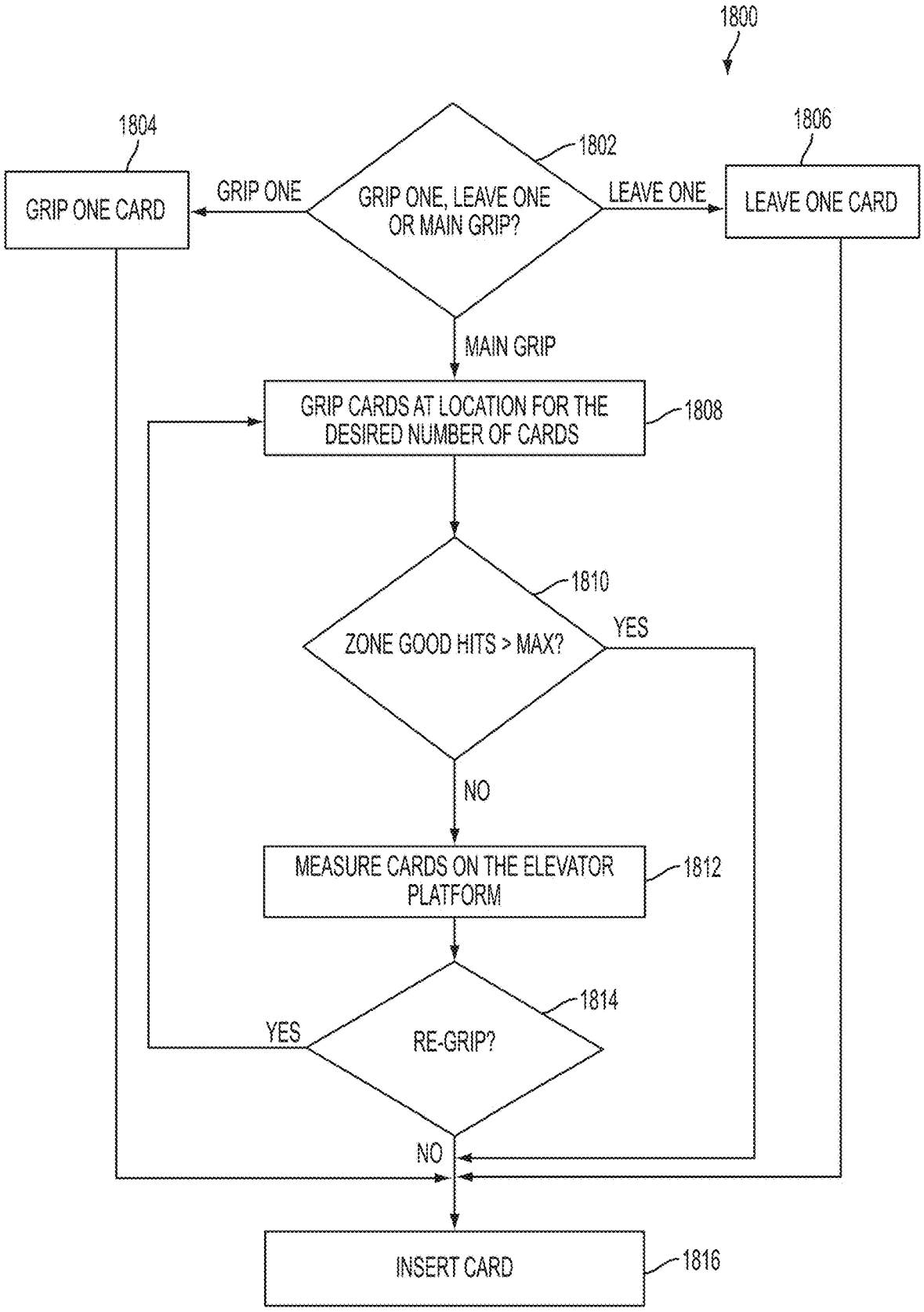

FIG. 18 is a flowchart 1800 illustrating a method for operating a card handling device 100 according to an embodiment of the present disclosure. In particular, the flowchart 1800 may provide additional details to operation 1506 of FIG. 15. For purposes of FIG. 18, it is assumed that the processor 350 has automatically generated and initialized the correction table 1200 (FIG. 12), the zone hit counter table 1300 (FIG. 13), and the re-try counter table 1400 (FIG. 14). The processor 350 may also determine where the card should be inserted within the shuffled set of cards being formed. The insertion position may be based on the virtual shuffle generated by the RNG. In particular, the processor 350 may determine where the current set of platform cards should be gripped to insert the card at the proper location to eventually form a shuffled set of cards that matches the virtual shuffle.

At operation 1802, the processor 350 may determine whether one card should be gripped (i.e., gripping the top card), whether one card should remain on the elevator platform 210 (i.e., leaving the bottom card), or whether the insert should occur at some other location within the shuffled set of cards (i.e., gripping somewhere within the deck).

If the processor 350 determines that one card should be gripped (i.e., the card insert should occur directly below the current top card), then a single card may be gripped at operation 1804. The gripper card present sensor 234 may be used to determine the position of the elevator platform 210 to have the top card gripped. The elevator platform 210 may be raised until the gripper card present sensor 234 detects the presence of the top card. The elevator platform 210 may be incremented and/or decremented a small number of steps (e.g., 2 steps) on each try to determine the point at which the gripper transitions between gripping a card and not gripping a card as detected by the gripper card present sensor 234. The card handling device 100 may retry (e.g., up to ten times) gripping at each interval before moving up if no cards were gripped. Thus, if the desired insertion location is determined to be directly below a top card of the stack of shuffled cards, gripping the top card may be achieved by moving the elevator platform incrementally until a single card is determined to be gripped. When one card is gripped, the next card is inserted at operation 1816.

If one card should be left on the elevator platform for the insert, then all the cards may be gripped except for the one card remaining on the elevator platform 210 at operation 1806. For leaving only one card (i.e., the bottom card) on the elevator platform 210, the platform card present sensor 211 may be used to confirm that the bottom card is the only card remaining on the elevator platform 210. For example, the elevator platform 210 may be moved to have the $2^{nd}$ card in the stack gripped. The elevator platform 210 may be incremented and/or decremented a small number of steps (e.g., 2 steps) on each try to determine the point at which the platform card present sensor 211 located on the elevator platform 210 transitions between having a card present on the elevator platform 210 and not having any cards present on the elevator platform 210. The card handling device 100 may retry (e.g., up to ten times) gripping at each interval before moving down if all cards were gripped. Thus, if the desired insertion location is determined to be directly above a bottom card of the stack of shuffled cards, gripping the stack of shuffled cards while leaving the bottom card may be achieved by moving the elevator platform incrementally until a single card is determined to remain on the elevator platform. When one card is remains on the elevator platform 210, the next card is inserted at operation 1816.

If the card insert should occur at some other location within the shuffled set of cards (i.e., the "main grip"), then the appropriate number of cards may be gripped at the location for the desired number of cards to remain on the elevator platform at operation 1808. The grip position of the cards may be determined based on the stored grip position for that number of cards adjusted according to the correction table 1200 (FIG. 12). The elevator platform 210 moves to that adjusted position and the card gripper 232 grips the cards. The elevator platform 210 then moves down in order to leave a gap for the card insertion.

At operation 1810, a zone good hits value may be compared to a maximum value. The zone good hits value is a value that indicates if a given zone has accurately inserted a card during a given shuffle. The maximum value may indicate how many accurate shuffles may be required before skipping the re-grip and correction table update process. For example, the maximum value may be 1, in which case a card in that zone may simply be inserted without checking for re-gripping and/or updating the correction table after 2 correct insertions have been executed within that zone. In some embodiments, the zone good hits value may not carry over to the next time the deck is shuffled in case the deck wear would justify checking the accuracy of the correction table values.

At operation 1812, the cards are measured on the elevator platform 210. In particular, the elevator platform 210 may be moved to until the top card remaining on the elevator platform 210 is detected by the top platform card sensor 236. The location of the elevator platform 210 is then read as the measured platform position, which is indicative of the height of the platform cards remaining after the grip.

At operation 1814, it is determined whether there should be a re-grip of the cards. If it is determined that a re-grip should occur, then the cards are again gripped according to operation 1808. Additional details regarding the determination for whether to re-grip the cards is discussed below with reference to FIG. 19. If it is determined that a re-grip should occur, the card gripper 232 may release the gripped cards back onto the platform cards. The elevator platform 210 may again move to the grip position (though the grip position may be adjusted for the re-grip) and the cards may be gripped again. This process may continue until operation 1814 determines that a re-grip should not occur.

At operation 1816, a card may be inserted into the gap onto the platform cards. The gripped cards may be released, and the processor 350 may determine the next grip position for the next card to be inserted in the shuffled set of cards being formed.

In some embodiments, gripping one card (operation 1804) and/or leaving one card on the elevator platform 210 (operation 1806) may be performed in a similar manner to the main grip (operations 1808-1814); however, the simplified method shown in FIG. 18 may result in fewer errors for these two unique situations than with comparing measured positions to reference positions. In some embodiments, there may be separate correction tables for each of these three situations. For example, there may be a separate correction table dedicated to gripping one card, another correction table dedicated to leaving one card on the elevator platform 210, and another correction table that is used for the rest of the card inserts. The correction tables for the "one card gripped" scenario may be one-dimensional as there is only one card to be gripped, and refers to the number of cards to remain on the elevator platform 210. The correction tables for the "one card remaining" scenario may be one-dimensional as there is only one card to remain, and refers to the number of cards to gripped on the elevator platform 210.

Figure 19:
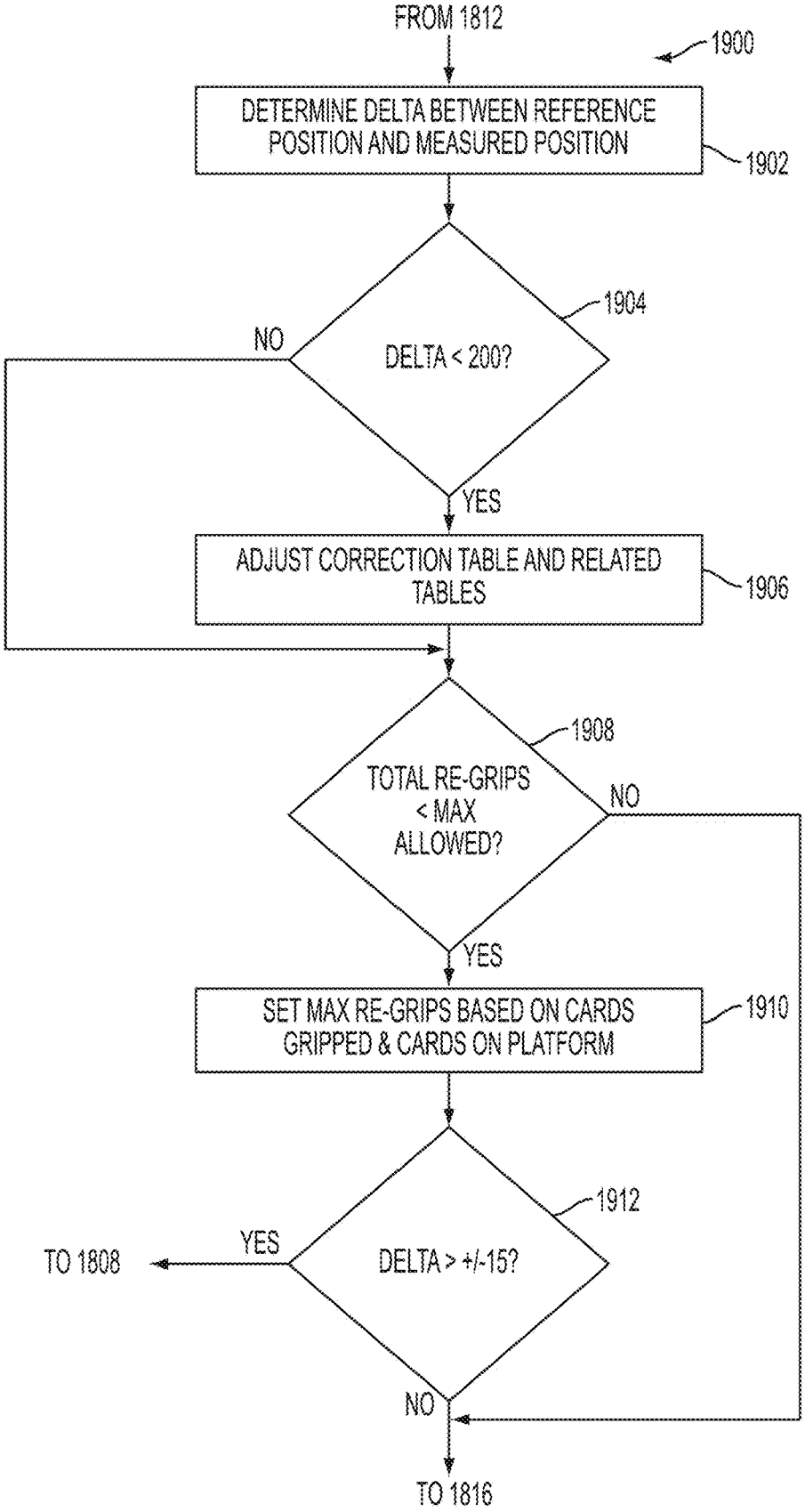

FIG. 19 is a flowchart 1900 illustrating a method for operating a card handling device 100 according to an embodiment of the present disclosure. In particular, the flowchart 1900 may provide additional details to operation 1814 of FIG. 18.

At operation 1902, the processor 350 may determine a difference (delta) between the reference position and the measured position of the elevator platform 210 after the grip for the top platform card to be detected by the top platform card sensor 236. The reference position may be the expected platform position that is expected for the number of cards desired to remain on the elevator platform 210 after the grip. As discussed above, the reference position may be generated by the one-dimensional method, the two-dimensional method, or the balanced approach based on both the one-dimensional method and the two-dimensional method. The measured position may be the platform position actually measured after the grip.

At operation 1904, it is determined whether the delta is less than some threshold. In this example, the threshold for the delta may be set at 200 steps. If the delta is less than the threshold, the correction table may be adjusted at operation 1906. The related tables (e.g., zone hit counter table, re-try counter table) may also be adjusted. These tables may be adjusted as described above with respect to FIGS. 12, 13, and 14. If the delta is not less than 200 steps, the correction table (and other tables) may not be adjusted.

At operation 1906, adjusting the correction table and related tables may be performed for most deltas; however, there may also be a smaller threshold (e.g., 10 steps) in which it may be close enough to allow the correction tables and related tables to not be adjusted. The first time the correction table is adjusted after initialization, the correction value may simply be the delta (e.g., as the initialization may be set at 0). If the correction table is adjusted (e.g., delta>10), the delta may be added to or subtracted from the current value of the zone cell associated with the current insert. In some embodiments, a different value may be added or subtracted. For example, the zone hit counter table may also be used to control the magnitude of the adjustments to the correction table. As the hits in a zone cell increase, the size of the adjustments to the correction table may decrease regardless on the actual delta. For example, the card handling device 100 may permit adjusting the correction table by ±5 steps for situations corresponding to a zone cell of the zone hit counter table having a value less than 8, permit adjusting the correction table by ±3 steps for situations corresponding to a zone cell of the zone hit counter table having a value between 10 and 19, and permit adjusting the correction table by ±2 step for situations corresponding to a zone cell of the zone hit counter table having a value greater than 19.

At operation 1908, the processor 350 may determine whether the maximum allowed total re-grips for a particular zone cell has been reached. If the total re-grips is above the maximum allowed threshold, the re-grip may not occur and the card may be inserted at operation 1816 (see FIG. 18). If, however, the total re-grips is not above the allowed threshold, the processor 350 may continue with the determination of whether or not to re-grip.

At operation 1910, the maximum re-grips allowed may be set based on the cards gripped and the cards remaining on the elevator platform 210. For example, some zone cells may permit 5 re-grips, whereas some zone cells may permit 4 re-grips. The number of allowed re-grips may depend on the likelihood of errors being present for grips in that particular zone.

At operation 1912, the delta may be compared with another lower threshold (e.g., ±15 steps). If the delta is an integer that is greater than the lower threshold, the re-grip is determined to be desirable, and the method continues to operation 1808 (see FIG. 18) to perform the re-grip. If, however, the delta is an integer that is not greater than the lower threshold, the method may continue and insert the card at operation 1816 (see FIG. 18).

While certain illustrative embodiments have been described in connection with the figures, those of ordinary skill in the art will recognize and appreciate that embodiments of the disclosure are not limited to those embodiments explicitly shown and described herein. Rather, many additions, deletions, and modifications to the embodiments described herein may be made without departing from the scope of embodiments of the disclosure as hereinafter claimed, including legal equivalents. In addition, features from one embodiment may be combined with features of another embodiment while still being encompassed within the scope of the disclosure as contemplated by the inventor.

What is claimed is:

1. A method for forming a randomized set of cards, comprising:

generating, with a random number generator (RNG), a random delivery order of a stack of shuffled cards;

determining, with a processor, an initial grip position of an elevator platform of a card handling device, the elevator platform configured to move relative to a position of a card gripper adjacent a card insert system;

determining, with the processor, an expected height of a set of cards remaining on the elevator platform;

measuring, with a top platform card sensor, an actual height of the set of cards remaining on the elevator platform;

determining, with the processor, an adjusted grip position of the elevator platform according to correction values indicating a magnitude of adjustment required to move the elevator platform from the initial grip position to the adjusted grip position based at least in part on a difference between the actual height of the set of cards remaining on the elevator platform and the expected height of the set of cards remaining on the elevator platform;

moving at least one of the elevator platform and the card gripper to create a gap in the set of cards for insertion of a card at the adjusted grip position; and moving the card into the gap in the set of cards with the card insert system.

2. The method of claim 1, further comprising creating and maintaining at least one correction table configured to store data received from monitoring a number of times a grip position is adjusted for each insertion location, wherein determining the adjusted grip position comprises using the data stored in the at least one correction table.

3. The method of claim 1, wherein determining the initial grip position of the elevator platform comprises calculating the initial grip position of the elevator platform based on the random delivery order of the stack of shuffled cards.

4. The method of claim 1, wherein determining the adjusted grip position of the elevator platform comprises:

measuring an initial height of the set of cards on the elevator platform with the top platform card sensor;

gripping a predetermined amount of cards with the card gripper to create the gap in the set of cards; and measuring another height of a portion of the set of cards remaining on the elevator platform after the gap in the set of cards is created.

5. The method of claim 4, further comprising re-gripping another amount of cards, different from the predetermined amount of cards with the card gripper if the adjusted grip position of the elevator platform is determined to be different than the initial grip position of the elevator platform.

6. The method of claim 4, wherein measuring the initial height of the set of cards on the elevator platform comprises measuring the initial height of the set of cards with the top platform card sensor before moving the card into the gap in the set of cards.

7. The method of claim 1, wherein moving at least one of the elevator platform and the card gripper comprises gripping an upper portion of cards with the card gripper and lowering the elevator platform to create the gap between a bottom card of the upper portion of cards and a top card of a lower portion of cards remaining on the elevator platform.

8. A method of operating a card handling device, comprising:

receiving a group of unshuffled cards in a card input area;

moving an elevator platform of a card handling area to a grip position determined at least in part on correction values indicating a degree of adjustment of the elevator platform from an initial grip position to an adjusted grip position depending on a difference between a measured height and an expected height of a group of shuffled cards remaining on the elevator platform, the measured height provided at least in part by a top platform card sensor, and the expected height determined by a processor and based at least in part on a random delivery order generated by a random number generator (RNG);

suspending at least one card of the group of shuffled cards above the elevator platform to create a gap in the group of shuffled cards; and moving a card from the group of unshuffled cards in the card input area to the card handling area and into the gap in the group of shuffled cards with a card insert system.

9. The method of claim 8, further comprising adjusting the correction values if the difference between the measured height of cards and the expected height of cards remaining on the elevator platform is greater than a predetermined value.

10. The method of claim 9, wherein adjusting the correction values comprises monitoring data relating to differences between the measured height of cards and the expected height of cards remaining on the elevator platform and dynamically adjusting the correction values during a shuffling operation.

11. The method of claim 8, wherein moving the elevator platform comprises adjusting the grip position of the elevator platform from the initial grip position to the adjusted grip position based on individual correction values that are varied for differing insert locations.

12. The method of claim 8, wherein suspending the at least one card of the group of shuffled cards above the elevator platform comprises:

gripping the at least one card with a card gripper positioned above the elevator platform; and lowering the elevator platform to create the gap in the group of shuffled cards.

13. The method of claim 8, wherein moving the card from the group of unshuffled cards in the card input area to the card handling area comprises conveying a bottom card from the group of unshuffled cards to the elevator platform with at least one roller of the card insert system.

14. A card handling device, comprising:

a card input area;

a card gripper within a card handling area of the card handling device;

an elevator platform adjacent and movable relative to the card gripper;

a top platform card sensor configured to detect alignment of a top card on the elevator platform with the top platform card sensor;

a card insert system comprising at least one roller adjacent to the card gripper, the at least one roller configured to convey cards from the card input area to the elevator platform;

a processor operably coupled to the elevator platform, wherein the processor is configured to cause the elevator platform to move to a grip position to create a gap in a set of cards for insertion of at least one card with the card insert system, the grip position of the elevator platform determined at least in part on correction values indicating a required movement to adjust the elevator platform from an initial grip position to an adjusted grip position depending at least in part on a height of cards on the elevator platform; and a random number generator (RNG) associated with the processor, wherein the processor is configured to determine the adjusted grip position of the elevator platform based at least in part on a difference between a measured height of cards on the elevator platform, as detected by the top platform card sensor, and a reference position of an expected height of cards on the elevator platform, as determined by the processor using a random delivery order generated by the random number generator (RNG).

15. The card handling device of claim 14, further comprising at least one additional card sensor, wherein the processor is configured to control the elevator platform based at least in part on information received from the at least one additional card sensor.

16. The card handling device of claim 14, wherein the processor is configured to determine the height of cards on the elevator platform using data generated by the top platform card sensor.

17. The card handling device of claim 14, wherein the processor is configured to receive and compile data of the height of cards on the elevator platform relative to a number of the cards on the elevator platform for a particular set of cards.

18. The card handling device of claim 14, wherein the processor is configured to automatically record and update information in a correction table, the information related to the height of cards on the elevator platform at particular grip positions of the elevator platform.

19. The card handling device of claim 14, wherein the processor is configured to determine the reference position based on at least one of average values of the height of cards on the elevator platform and a combination of a number of cards to be gripped and a number of cards remaining on the elevator platform.

* * * * *